US006770430B1

(12) United States Patent
Kubo

(10) Patent No.: US 6,770,430 B1
(45) Date of Patent: Aug. 3, 2004

(54) THERMALLY PROCESSED IMAGE FORMING MATERIAL

(75) Inventor: Toshiaki Kubo, Minami-ashigara (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 0 days.

(21) Appl. No.: 09/640,803

(22) Filed: Aug. 18, 2000

(30) Foreign Application Priority Data

Aug. 20, 1999 (JP) ..... 11/233911

(51) Int. Cl.[7] ..... G03C 1/498; G03C 1/76

(52) U.S. Cl. ..... 430/523; 430/531; 430/619; 430/631

(58) Field of Search ..... 430/617, 619, 430/523, 531, 631

(56) References Cited

U.S. PATENT DOCUMENTS 6,287,754 B1 * 9/2001 Melpolder et al. ..... 430/527

FOREIGN PATENT DOCUMENTS

| | | | | |
|---|---|---|---|---|
| EP | 0171810 | | 2/1986 | |
| EP | 0518552 | A1 | 12/1992 | |
| EP | 0803766 | A1 | 10/1997 | |
| EP | 0810467 | A1 | 12/1997 | |
| EP | 0902322 | A1 | 3/1999 | |
| EP | 0 902 322 | * | 3/1999 | ..... G03C/1/498 |
| EP | 0903629 | A1 | 3/1999 | |
| JP | 2000162731 | A | 6/2000 | |

* cited by examiner

*Primary Examiner*—Thorl Chea
(74) *Attorney, Agent, or Firm*—Birch, Stewart, Kolasch & Birch, LLP

(57) ABSTRACT

A therally processed image forming material less causative of adhesion during storage in a form of commercial product is provided. The thermally processed image forming material has on only one side of a support an image forming layer, in which the outermost layer on the same side with the image forming layer contains a binder different from that contained in the outermost layer on the opposite side of the support.

10 Claims, 1 Drawing Sheet

THERMALLY PROCESSED IMAGE FORMING MATERIAL

TECHNICAL FIELD

Figure 1:
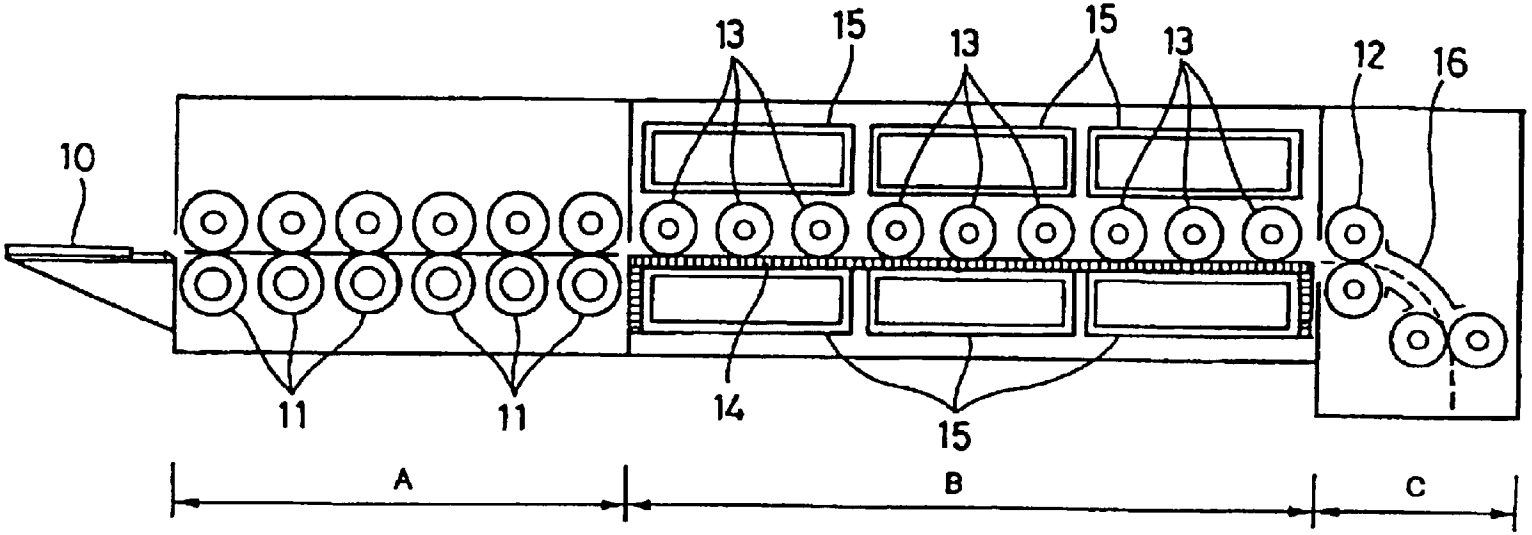

The present invention relates to a thermally processed image forming material less causative of adhesion in a form of commercial product.

BACKGROUND ART

A strong need for reducing the volume of waste process solution has arisen in recent field of printing from viewpoints of environmental preservation and space saving. Thus a recording material requiring no conventional step for solution development, fixation nor water washing is desired.

A thermally processed image forming material for producing photographic image based on heat development is disclosed, for example, in U.S. Pat. Nos. 3,152,904 and 3,457,075 and "Thermally Processed Silver Systems" written by D. Morgan and B. Shely, Imaging Processes and Materials, Neblette's 8th ed., edited by Sturge, V. Walworth and A. Shepp, Item 2 (1989). Such thermally processed image forming material is hopeful of applications in various fields for the advantages of its mono-sheet constitution and development only by a heat processing.

The image recording material based on the heat development process is generally developed at 80 to 150° C., so that when the material is intended for use in printing purpose, using gelatin as a binder as being practiced in the conventional photographic photosensitive material, will raise a problem that a significant dimensional change may occur due to shrinkage of the gelatin. While such dimensional change has been suppressed to a level of no problem in the practical use by using a polymer binder not shrinkable by heat, there is occurring a new problem that the material in a product form of rolled sheet or stacked sheets may result in adhesion between the outermost layers when allowed to stand under high temperatures (for example, 30° C. or above).

It is therefore an object of the present invention to solve the foregoing problems. That is, the present invention is to provide a thermally processed image forming material less causative of adhesion in a form of commercial product.

SUMMARY OF THE INVENTION

The present inventors found after extensive investigations for solving the foregoing problem that an thermally processed image forming material less causative of adhesion can be obtained by specifying binders used in the outermost layers on both planes of the material; which led us to propose the present invention.

That is, the present invention is to provide a thermally processed image forming material having on only one side of a support an image forming layer characterized in that the outermost layer on the same side with the image forming layer contains a binder different from that contained in the outermost layer on the opposite side of the support.

Preferred embodiments of the present invention include such that the binder contained in the outermost layer on the same side with the image forming layer and the binder contained in the outermost layer on the opposite side of the support have a common monomer composition to a degree less than 75 wt %; such that a ratio of an I/O value of the binder contained in the outermost layer on the same side with the image forming layer and an I/O value of the binder contained in the outermost layer on the opposite side of the support is within a range from 0.1 to 0.90, or within a range from 1.10 to 10; such that the binder contained in the outermost layer on the opposite side of the support has a softening point of 100° C. to 250° C.; such that the binder contained in the outermost layer on the opposite side of the support has a softening point higher than a glass transition point of said binder by 30° C. or more; such that a ratio of a Vickers hardness of the binder contained in the outermost layer on the same side with the image forming layer and a Vickers hardness of the binder contained in the outermost layer on the opposite side of the support is within a range from 0.1 to 0.95, or within a range from 1.05 to 10; such that the binder contained in the outermost layer on the same side with the image forming layer or on the opposite side of the support contains a polymer latex in an amount of 50 wt % or more of the total binder; such that the outermost layer on the same side with the image forming layer or on the opposite side of the support contains a fluorine-containing surfactant; such that the outermost layer on the same side with the image forming layer or on the opposite side of the support contains a slipping aid; and such that the image forming layer contains an organic acid silver salt and a reducing agent.

The above and other objects and features of the invention are apparent to those skilled in the art from the following referred embodiments thereof when considered in conjunction with the accompanied drawing, in which:

FIG. 1 is a side view showing an exemplary constitution of a heat developing apparatus used for heat-developing the thermally processed image forming material of the present invention.

DETAILED DESCRIPTION OF THE INVENTION

The thermally processed image forming material of the present invention will be detailed hereinafter.

The thermally processed image forming material of the present invention is such that having on only one side of a support an image forming layer. For convenience of the explanation hereinafter, of both sides of the support, the side having an image forming layer is defined as an "image producing plane" and the opposite side thereof as a "back plane".

The thermally processed image forming material of the present invention is characterized in that the binder contained in the outermost layer of the image producing-plane differs from the binder contained in the outermost layer of the back plane. That is, the binder in the outermost layer of the image producing plane and the binder in the outermost layer of the back plane differ with each other in the species or composition thereof.

The binder for use in the outermost layers of the image producing plane and back plane can arbitrarily be selected from well-known natural or synthetic resins (e.g., gelatin, polyvinyl acetal, polyvinyl chloride, polyvinyl acetate, cellulose acetate, polyolefin, polyester, polystyrene, polyacrylonitrile and polycarbonate) and polymer latex. Preferable examples of the binder include polyvinyl butyral, cellulose acetate butylate, methacrylate copolymer, maleic anhydride ester copolymer, polystyrene, butadiene-styrene copolymer and polymer latex. These binders may be used individually or in combination of two or more thereof as required.

In the thermally processed image forming material of the present invention; the polymer latex preferably accounts for 50 wt % or more of the total binder, and more preferably 70 wt % or more.

Now, the "polymer latex" in the context of this specification is defined as a water-insoluble hydrophobic polymer being dispersed as fine particles in a water-soluble dispersion medium. The dispersion may have any form of polymer emulsified in dispersion medium, emulsion-polymerized or dispersed as micells; or the polymer can be dispersed so that its molecular chain per se disperses when the polymer has, in a part of its body, some hydrophilic structure. Details for such polymer latex available in the present invention are found, for example, in "Gosei Jushi Emulsion (Synthetic Resin Emulsion)", ed. by Taira Okuda and Hiroshi Inagaki, issued by Kobunshi Kanko Kai (1978); "Gosei Latex no O-yo (Applications of Synthetic Latex)", ed. by Takaaki Sugimura, Yasuo Kataoka, Souichi Suzuki and Keiji Kasahara, issued by Kobunshi Kanko Kai (1993); and Soichi Muroi, "Gosei Latex no Kagaku (Chemistry of Synthetic Latex)", issued by Kobunshi Kanko Kai (1970). The dispersed particles preferably have an average particle size of 1 to 50,000 nm, more preferably approx. 5 to 1,000 nm. The particle size distribution of the dispersed particles is not particularly limited, and the dispersed particles may have a broad grain size distribution or a monodisperse grain size distribution.

As the polymer latex for use in the present invention, not only an ordinary uniform-structured polymer latex but also a so-called core/shell type latex are available. In some cases, it is preferred that the core and the shell have different glass transition points.

The polymer latex for use in the present invention preferably has a minimum film-forming temperature (MFT) of from −30 to 120° C., more preferably from 0 to 90° C. In order to control the MFT, a film-forming aid may be added. The film-forming aid, also called a plasticizer, refers to an organic compound (usually an organic solvent) capable of lowering the MFT of the polymer latex, which is described in "Gosei Latex no Kagaku (Chemistry of Synthetic Latex)", by Souichi Muroi, issued by Kobunshi Kanko Kai (1970), supra.

The polymer species of the polymer latex available for the outermost layers are the same as those described for the image forming layer. The polymer may be a straight-chained polymer, a branched polymer or a cross-linked polymer. The polymer may be a so-called homopolymer consisting of a single kind of monomer or may be a copolymer consisting of two or more kinds of monomers. Both of random copolymer and block copolymer are allowable as the copolymer. The polymer preferably has a number average molecular weight of from 5,000 to 1,000,000, and more preferably from 10,000 to 100,000. Too small molecular weight will result in poor mechanical strength of the image forming layer, whereas too large in degraded and undesirable film-forming property.

A polymer composing the polymer latex for use in the outermost layers is preferably such that having an equilibrium moisture content of 2 wt % or less at 25° C. and relative humidity (abbreviated as "RH" hereinafter) of 60%, and more preferably 1 wt % or less. Definition and measurement method of equilibrium moisture content can be referred to the description of "Kobunshi Zairyo Shiken-ho (Test Methods for Polymer Materials)"in the series of "Kobunshi Kogaku Koza 14 (Polymer Engineering Course 14)", edited by Polymer Society, published by Chijin Shokan.

Specific examples of the polymer latex for use in the present invention include methyl methacrylate/ethyl acrylate/methacrylic acid copolymer latex, methyl methacrylate/2-ethylhexyl acrylate/styrene/acrylic acid copolymer latex, styrene/butadiene/acrylic acid copolymer latex, styrene/butadiene/divinylbenzene/methacrylic acid copolymer latex, methyl methacrylate/vinyl chloride/acrylic acid copolymer latex, and vinylidene chloride/ethyl acrylate/acrylonitrile/methacrylic acid copolymer latex. Such polymers are also commercially available, which include acrylic resins such as CEBIAN A-4635, 46583 and 4601 (all produced by Dicel Chemical Industries, Ltd.) and Nipol Lx811, 814, 821, 820, 857 (all produced by Nippon Zeon KK), JURIMER ET-410 (Nippon Jun'yaku KK); polyester resins such as FINETEX ES650, 611, 675, 850 (all produced by Dai-Nippon Ink & Chemicals, Inc.), WD-size and WMS (both produced by Eastman Chemical), Vylon 200, 103, 300, 500, 600 (produced by Toyobo, Co., Ltd.); polyurethane resins such as HYDRAN AP10, 20, 30, 40 (all produced by Dai-Nippon Ink & Chemicals, Inc.); rubber-based resins such as LACSTAR 7310K, 3307B, 4700H, 7132C (all produced by Dai-Nippon Ink & Chemicals, Inc.), Nipol Lx416, 410, 438C and 2507 (all produced by Nippon Zeon KK); vinyl chloride resins such as G351, G576 (both produced by Nippon Zeon KK); vinylidene chloride resins such as L502, L513 (both produced by Asahi Chemical Industry Co., Ltd.), ARON D7020, D504 and D5071 (all produced by Mitsui Chemical Co., Ltd.); and olefin resins such as CHEMIPEARL S120 and SA100 (both produced by Mitsui Chemical Co., Ltd.). These polymers may be used individually or, as required, as a blend of two or more species.

To the outermost layers, it is allowable to add, as required, hydrophilic polymer such as gelatin, polyvinyl alcohol, methylcellulose, hydroxypropylcellulose, carboxymethylcellulose, and hydroxypropylmethylcellulose. The amount of addition of these hydrophilic polymers is preferably 30 wt % or less of the total binder of the outermost layers, and more preferably 15 wt % or less.

In the present invention, the binder used in the outermost layer of the image producing plane and the binder used in the outermost layer of the back plane differ with each other. A preferable case relates to that two these binders have a common monomer composition to a degree less than 75 wt %. That is, it is preferable that 25 wt % or more of the monomer composition is constituted by non-common monomers. A plurality of embodiments described below are also preferable.

The ratio of an I/O value of the binder contained in the outermost layer on the same side with the image forming layer and an I/O value of the binder contained in the outermost layer on the opposite side of the support is within a range from 0.1 to 0.90, or within a range from 1.10 to 10.

The "I/O value" in the context of this specification refers to a value obtained by dividing an inorganicity value based on the conceptional organic chart by an organicity value, as described in "Yuki Gainenzu-Kiso to Oyo (Organicity Chart—Basics and Applications), written by Yoshio Koda, published by Sankyo Shuppan (1984).

The organicity chart described herein is obtained by plotting every kind of organic substance on a rectangular coordinates having the organic axis and the inorganic axis according to properties of the individual organic substances expressed by a combination of inorganicity value representing a degree of covalence of the bond and an organicity value representing a degree of ionicity of the bond. The organicity value is an index for organicity, that is a value expressing a magnitude of influence of various substituents on the boiling point assuming the magnitude of influence of a single hydroxyl group as 100, which is derived from a fact that a boiling curve of a straight-chain alcohol is approx.

100° C. distant from a boiling curve of a straight-chain paraffin at a carbon number of 5 or around. On the other hand, the organicity value is based on a concept that the value depends on the number of carbon atoms representing a methylene group which is assumed as a basic unit of the molecule, where a basic value for one carbon atom is defined as 20 since the boiling point rise caused by adding one carbon atom to a straight-chain compound having a 5 to 10 carbon atoms is 20° C. in average. The inorganicity value and organicity value are in an one-to-one correspondence on the graph, and the I/O value is calculated from these values.

In the thermally processed image forming material of the present invention, the binder contained in the outermost layer on the opposite side of the support preferably has a softening point of 100° C. to 250° C., and more preferably 120° C. to 250° C. The softening point of polymer refers to a temperature at which the polymer easily starts to deform. Methods for measuring there of include the ring-and-ball test, Martens' heat resistance test measuring heat distortion, Vicat test and heat deformation temperature test.

The binder contained in the outermost layer on the opposite side of the support preferably has a softening point higher than a glass transition point ($T_g$) of said binder by 30° C. or more. $T_g$s of polymer are described in "Polymer Handbook", pages III-139to III-179, written by Brandlap, published by Wairy and Sons (1966), according to which a $T_g$ (°K) of a copolymer is expressed as $$T_g(\text{copolymer})=v_1T_{g1}+v_2T_{g2}+\ldots+v_wT_{gw}$$

where $v_1$, $v_2$ . . . $v_{gw}$ are weight fractions of individual monomers constituting the copolymer, and $T_{g1}$, $T_{g2}$ . . . $T_{gw}$ are $T_g$s (°K) of homopolymers of individual monomers constituting the copolymer. $T_g$s calculated according to the above equation have an accuracy of ±5° C.

The ratio of a Vickers hardness of the binder contained in the outermost layer on the same side with the image forming layer and a Vickers hardness of the binder contained in the outermost layer on the opposite side of the support is preferably within a range from 0.1 to 0.95, or within a range from 1.05 to 10.

The Vickers hardness described in this specification can be measured conforming to JIS (Japanese Industrial Standard) Z2251 "Microhardness Test Method". More specifically, it is proportional to a quotient obtained by dividing F (kgf) by the surface area $d^2$ ($mm^2$) such as $$\text{Vickers hardness } (Hv)=1.8544F/d^2$$

where F is a load applied to the tested surface when a diamond-made indenter in a form of a right quadrangular pyramid having an opposing angle of 136° is pressed to form a pit, and d is an average length (mm) of the diagonal of the pit. The measurement apparatus must conform to JIS B7734 (microhardness tester). The present invention adopted a value obtained by pressing the indenter to a depth of 1 $\mu$m using a measurement apparatus Model H100VP (product of Fischer-Scope) at 25° C. and under the relative humidity of 50%.

The thermally processed image forming material of the present invention preferably contains a fluorine-containing surfactant. While there is no limitation on a layer to which the fluorine-containing surfactant is added, preferable is the outermost layer of the image producing plane or the outermost layer of the back plane. This will result in an improved quality of the coated surface.

Examples of the fluorine-containing surfactant are such that having a fluoroalkyl group, fluoroalkenyl group or fluoroaryl group, all of which having a carbon number of 4 or more (15 or less in general), and an ionic group selected from anionic groups [sulfonic acid (salt), sulfuric acid (salt), carboxylic acid (salt), phosphoric acid (salt)], cationic groups (amine salt, ammonium salt, aromatic amine salt, sulfonium salt, phosphonium salt), betaine groups (carboxyamine salt, carboxyammonium salt, sulfoamine salt, sulfoammonium salt, phosphoammonium salt), or non-ionic groups (substituted or unsubstituted polyoxyalkylene group, polyglyceryl group, sorbitan group).

These fluorine-containing surfactants are disclosed, for example, in JP-A-49-10722 (the code "JP-A" as used herein means an "unexamined published Japanese patent application"), British Patent No. 1,330,356, U.S. Pat. Nos. 4,335,201 and 4,347,308, British Patent No. 1,417,915, JP-A-55-149938, JP-A-58-196544 and British Patent 1,439,402.

These surfactants may be used separately or in combination of two or more thereof, where the amount of addition thereof is preferably 0.001 to 0.1 g/$m^2$ in total of both planes.

The outermost layer of the thermally processed image forming material preferably contains a slipping aid. The slipping aid in the present invention may be any compound so long as, when provided on the surface of an object, it can lower the friction coefficient of such surface as compared with the surface not provided with such compound.

Specific examples of the slipping aid are typified as those described in the paragraphs [0061] to [0064] of JP-A-11-84573, and the paragraphs [0049] to [0062] of JP-A-11-106881. Preferable slipping aids are available as Cellosol 524 (major component: carnauba wax), Polyron A, 393, H-481 (major component: polyethylene wax), Himicron G-110 (major component: ethylene bisstearate amide), Himicron G-270 (major component: amide stearate) (all produced by Chukyo Yushi K.K.) and the compounds expressed by the formula below:

W-1: $C_{16}H_{33}$—O—$SO_3Na$, and

W-1: $C_{18}H_{37}$—O—$SO_3Na$.

The amount of addition of the slipping aid is preferably 0.1 to 50 wt % of the binder in the target layer, and more preferably 0.5 to 30 wt %.

A variety of supports are available for the thermally processed image forming material of the present invention. Typical materials for the support include polyesters such as polyethylene terephthalate and polyethylene naphthalate; cellulose nitrate; cellulose ester; polyvinyl acetal; syndiotactic polystyrene; polycarbonate; and paper having both plane thereof coated with polyethylene. Among these, a biaxially stretched polyester, in particular such polyethylene terephthalate (PET) is preferable in terms of its excellent dimensional stability and chemical resistance. The thickness of the support, excluding that of the undercoat layer, is preferably 90 to 180 $\mu$m.

As the support of the thermally processed image forming material of the present invention, preferably used is a polyester film, and in particular polyethylene terephthalate film, annealed at 130 to 185 ° C. to relax residual internal stress caused by the biaxial stretching and thereby to prevent heat-shrinking distortion during the heat development; such film typically disclosed in JP-A-10-48772, JP-A-10-10676, JP-A-10-10677, JP-A-11-65025 and JP-A-9-308898.

Rate of dimensional change of the support after annealed at 120° C. for 30 seconds is preferably −0.03 to +0.01% in the moving direction (MD) and 0 to +0.04% in the transverse direction (TD).

On the substrate, it is optionally allowable to form, by coating, an undercoat layer containing SBR (styrene butadiene rubber), polyester or gelatin as a binder, in addition to the vinylidene chloride copolymer layer. These undercoat layers can be formed in a multi-layered structure, and can be provided either on the single side or both sides of the support. Typical thickness of the undercoat layer (per layer) is 0.01 to 5 $\mu$m, and more preferably 0.05 to 1 $\mu$m.

On both planes of the support of the thermally processed image forming material of the present invention, it is preferable to provide an undercoat layer containing a vinylidene chloride copolymer containing a repetitive unit of vinylidene chloride monomer at 70 wt % or above. Such copolymer is disclosed, for example, in JP-A-64-20544, JP-A-1-180537, JP-A-1-209443, JP-A-1-285939, JP-A-1-296243, JP-A-2-24649, JP-A-2-24648, JP-A-2-184844, JP-A-3-109545, JP-A-3-137637, JP-A-3-141346, JP-A-3-141347, JP-A-4-96055, U.S. Pat. No. 4,645,731, JP-A-4-68344, from line 20 in the right column on page 2 to line 30 in the right column on page 3 of Japanese Patent No. 2,557,641, paragraphs from [0020] to [0037] of JP-A-2000-39684, and paragraphs from [0063] to [0080] of Japanese Patent Application No. 11-106881.

The amount of vinylidene chloride monomer of less than 70 wt % will result in insufficient moisture resistance, and will cause large dimensional changes with time after the heat development. The vinylidene chloride copolymer preferably contains, as a repetitive unit other than the vinylidene chloride monomer, a repetitive unit of a vinyl monomer containing a carboxyl group. This is because a polymer consisting only of vinyl chloride monomers may crystallize, which makes it difficult to form a uniform moisture-proof layer by coating, and also because the vinyl chloride monomer containing the carboxyl group is indispensable for stabilizing the polymer.

The molecular weight of the vinylidene chloride copolymer, as expressed in weight average molecular weight, is preferably 45,000 or below, and more preferably 10,000 to 45,000. Too large molecular weight may degrade the adhesiveness of the vinylidene chloride layer and the support made of polyester or the like.

Content of the vinylidene chloride, as expressed in the total thickness of the undercoat layers containing thereof on one side of the support, is 0.3 $\mu$m or above, and more preferably 0.3 to 4 $\mu$m.

The vinylidene chloride copolymer layer as an undercoat layer is preferably provided as a first layer formed directly on the support, and may be provided in two or more layers, while one layer each on both sides of the support being the general practice. When two or more layers are provided, total amount of the vinylidene chloride copolymer will be adjusted within the desired range.

Such layer may contain, besides the vinylidene chloride copolymer, a crosslinking agent or a matting agent.

A thermally processed image forming material of the present invention has an image forming layer on only one side of a support. The image forming layer preferably contains an organic acid silver salt and a reducing agent, and also a photosensitive silver halide, binder and so forth.

The organic acid silver salt available in the present invention is a silver salt such that being relatively stable against the light but can produce silver image when heated at 80° C. or higher in the presence of light-exposed photocatalyst (e.g., latent image of photosensitive silver halide) and the reducing agent. The organic acid silver salt can be an arbitrary organic substance containing a source capable of reducing silver ion. Preferable are salts of organic acids and in particular salts of long-chain aliphatic carboxylic acid (with a carbon number of 10 to 30, and more preferably 15 to 28). Also preferable are complexes of organic or inorganic acid silver salts, the ligands of which having a stability constant of complex of 4.0 to 10.0. The silver source substance preferably accounts for approx. 5 to 70 wt % o the image forming layer. Preferable organic acid silver salts includes silver salts of organic substances having a carboxylic group. Examples of which include silver salts of aliphatic carboxylic acid and aromatic carboxylic acid, while being not limited thereto. Preferable silver salts of aliphatic carboxylic acids include silver behenate, silver arachidinate, silver stearate, silver oleate, silver laurate, silver caproate, silver myristate, silver palmitate, silver maleate, silver fumarate, silver tartrate, silver linoleate, silver butyrate, silver camphorate and mixtures thereof.

Among these organic acid silver salts or mixtures thereof, it is preferable to use an organic acid silver salt having a silver behenate content of 75 mol % or more, and more preferably 85 mol % or more. The silver behenate content described herein refers to a molar fraction of silver behenate in the total organic acid silver salt in use. The organic acid silver salts other than silver behenate can preferably be selected from those listed above.

While the organic acid silver salts may be used in a desired amount in the present invention, a preferable range resides in 0.1 to 5 g/m$^2$ as an silver amount, and more preferably 1 to 3 g/m$^2$.

The organic acid silver salt preferably used in the present invention can be prepared by reacting silver nitrate with a solution or suspension of an alkali metal salt (sodium salt, potassium salt, lithium salt or the like) of the organic acid listed above. A method disclosed in the paragraphs [0019] to [0021] of Japanese Patent Application No. 11-104187 will be a good reference for such preparation.

In the present invention, a preferable method for preparing the organic acid silver salt relates to adding an aqueous silver nitrate solution and a solution of an organic acid alkali metal salt into a closed liquid mixing means. A method disclosed in Japanese Patent Application No. 11-203413 will be a good reference for such preparation.

In the preparation of the organic acid silver salt in the present invention, it is allowable to add a water-soluble dispersion aid to the aqueous silver nitrate solution, the solution of organic acid alkali metal salt or the reaction mixture. Specific examples of species and amount of use of the dispersion aid are described in the paragraph [0052] of Japanese Patent Application No. 11-115457.

The organic acid silver salt used in the present invention is preferably prepared in the presence of a tertiary alcohol. The tertiary alcohol used in the present invention preferably has a total carbon number of 15 or below, and more preferably 10 or below. A preferable example of such tertiary alcohol relates to tert-butanol, while being not limited thereto.

While the tertiary alcohol used in the present invention may be added at any timing during the preparation of the organic acid silver salt, it is preferable to add the alcohol at the time of preparation of the alkali metal salt of the organic acid and to use the alkali metal salt of the organic acid in a dissolved state. Amount of addition of the tertiary alcohol may be selected at an arbitrary ratio by weight within a range from 0.01 to 10 relative to $H_2O$ as a solvent used for preparing the organic acid silver salt, and preferably from 0.03 to 1.

While there is no specific limitation on the shape or size of the organic acid silver salt grains, such that described in the paragraph [0024] of Japanese Patent Application No. 11-104187 is preferable. The shape of the organic acid silver salt can be determined based on the image of organic acid silver salt dispersion observed with a transmission electron microscope. Another method for determining the monodispersibility is such that obtaining the standard deviation of volume weighted mean diameter of the organic acid silver salt. The percentage (coefficient of variation) of the value obtained by dividing the standard deviation by the volume weighted mean diameter is preferably 80% or less, more preferably 50% or less, and still more preferably 30% or less. The measurement procedures include irradiating laser light to the organic acid silver salt dispersed in a solution; deriving an autocorrelation function with respect to the time-dependent fluctuation in the scattered light intensity; and thereby obtaining grain size (volume weighted mean diameter). Preferable is a solid grain dispersion with an average grain size of 0.05 to 10.0 $\mu$m, more preferably 0.1 to 5.0 $\mu$m, and still more preferably 0.1 to 2.0 $\mu$m.

The organic acid silver salt grains for use in the present invention is preferably desalted. Methods for desalting are not limitative and any known method is permissible, where centrifugal filtration, suction filtration, ultrafiltration, and flocculation washing based on coagulation are preferable. Ultrafiltration can be conducted according to the description in Japanese Patent Application No. 11-115457.

The organic acid silver salt grains for use in the present invention are made into the solid grain dispersion and then used to form the image forming layer. The solid grain dispersion of the organic acid silver salt comprises at least the organic acid silver salt and water. While there is no specific limitation on the ratio of the organic acid silver salt and water, the organic acid silver salt preferably accounts for 5 to 50 wt % of the whole dispersion, and more preferably 10 to 30 wt %. Using the above-described dispersion aid is preferable provided that it is used in a minimum amount within a range suitable for minimizing the grain size, and preferable range thereof is 0.5 to 30 wt % relative to the organic acid silver salt, and more preferably 1 to 15 wt %.

To obtain a solid grain dispersion of the organic acid silver salt with a small grain size and no coagulation and allowing a high S/N ratio, it is preferable in the present invention to first prepare a water-base dispersion containing the organic acid silver salt as an image producing medium but substantially no photosensitive silver salt, convert the dispersion into a high-speed flow, and then dropping the pressure to effect dispersion. Such dispersion methods are disclosed in the paragraphs [0027] to [0038] of Japanese Patent Application No. 11-104187.

In the present invention, it is preferable to add a metal ion selected from the group consisting of Ca, Mg, Zn and Ag to the non-photosensitive organic acid silver salt. Such metal ion selected from the group consisting Ca, Mg, Zn and Ag is preferably added in a form of a water-soluble salt other than halide, and more specifically, in a form of nitrate or sulfate. The addition in a form of halide is undesirable since it may degrade the image storability against light exposure (room light or sun ray), which is referred as so-called print-out property. Hence the addition in a form of a water-soluble metal salt rather than a halide is preferable in the present invention.

The metal ion selected from the group consisting of Ca, Mg, Zn and Ag can be added at any timing provided that it is effected after the formation of the non-photosensitive organic acid silver salt grains and immediately before the coating; such as immediately after the grain formation of the non-photosensitive organic acid silver salt grains, before or after the dispersion, or before or after the preparation of the coating liquid. The addition after the dispersion, and the addition before or after the preparation of the coating liquid are preferable.

The amount addition of the metal selected from the group consisting of Ca, Mg, Zn and Ag is preferably $10^{-3}$ to $10^{-1}$ mol per mol of the non-photosensitive organic acid silver salt, and more preferably $5\times10^{-3}$ to $5\times10^{-2}$ mol.

The reducing agent for reducing the organic acid silver salt may be an arbitrary substance capable of reducing silver ion into metal silver, and preferably an organic substance. While conventional photographic developers such as phenidone, hydroquinone and catechol are useful, a hindered phenol reducing agent is preferred. The reducing agent is preferably contained in an amount of from 5 to 50 mol % per mol of silver contained elsewhere on the side having the image forming layer, and more preferably from 10 to 40 mol %.

A layer to which the reducing agent is added may be any layer on the same side with the image forming layer on the substrate. In the case of adding the reducing agent to a layer other than the image forming layer, the reducing agent is preferably used in a slightly larger amount of from 10 to 50 mol % per mol of silver.

The reducing agent may also be a so-called precursor which is derived to effectively exhibit its function only at the time of development.

For thermally processed image forming material using an organic acid silver salt, a wide variety of reducing agents are known, for example, in JP-A-46-6074, JP-A-47-1238, JP-A-47-33621, JP-A-49-46427, JP-A-49-115540, JP-A-50-14334, JP-A-50-36110, JP-A-50-147711, JP-A-51-32632, JP-A-51-1023721, JP-A-51-32324, JP-A-51-51933, JP-A-52-84727, JP-A-55-108654, JP-A-56-146133, JP-A-57-82828, JP-A-57-82829, JP-A-6-3793, U.S. Pat. Nos. 3,679,426, 3,751,252, 3,751,255, 3,761,270, 3,782,949, 3,839,048, 3,928,686 and 5,464,738, German Patent No. 2,321,328 and European Patent No. 692,732. Examples thereof include amidoximes such as phenylamidoxime, 2-thienylamidoxime and p-phenoxyphenylamidoxime; azines such as 4-hydroxy-3,5-dimethoxy-benzaldehyde azine; combinations of an aliphatic carboxylic acid arylhydrazide with an ascorbic acid, such as a combination of 2,2'-bis(hydroxymethyl)propionyl-β-phenylhydrazine with ascorbic acid; combinations of polyhydroxybenzene with hydroxylamine, reductone and/or hydrazine (e.g. combination of hydroquinone with bis(ethoxyethyl)hydroxylamine, piperidinohexose reductone or formyl-4-methylphenylhydrazine; hydroxamic acids such as phenylhydroxamic acid, p-hydroxyphenylhydroxamic acid and β-anilinehydroxamic acid; combinations of azine with sulfonamidophenol such as a combination of phenothiazine with 2,6-dichloro-4-benzenesulfonamidophenol; α-cyanophenylacetic acid derivatives such as ethyl-α-cyano-2-methylphenyl acetate and ethyl-α-cyanophenyl acetate; bis-β-naphthols such as 2,2'-dihydroxy-1,1'-binaphthyl, 6,6'-dibromo-2,2'-dihydroxy-1,1'-binaphthyl and bis(2-hydroxy-1-naphthyl)methane; combinations of bis-β-naphthol with 1,3-dihydroxybenzene derivative (e.g., 2,4-dihydroxybenzophenone or 2',4'-dihydroxyacetophenone); 5-pyrazolones such as 3-methyl-1-phenyl-5-pyrazolone; reductones such as dimethylaminohexose reductone, anhydrodihydroaminohexose reductone and anhydrodihydropiperidonehexose reductone; sulfonamidophenol reducing agents such as 2,6-dichloro-4-benzenesulfonamidophenol and p-benzenesulfonamidophenol; 2-phenylindane-1,3-diones; chromans such as 2,2-dimethyl-7-t-butyl-6-hydroxychroman; 1,4-dihydropyridines such as 2,6-dimethoxy-3,5-dicarboethoxy-1,4-dihydropyridine; bisphenols such as bis(2-hydroxy-3-t-butyl-5-methylphenyl) methane, 2,2-bis(4-hydroxy-3-methylphenyl)propane, 4,4-ethylidene-bis(2-t-butyl-6-methylphenol), 1,1-bis(2-hydroxy-3,5-dimethylphenyl)-3,5,5-trimethylhexane and 2,2-bis(3,5-dimethyl-4-hydroxyphenyl)propane; ascorbic acid derivatives such as 1-ascorbyl palmitate and ascorbyl stearate; aldehydes and ketones such as benzyl and biacetyl; 3-pyrazolidone and a certain kind of indane-1,3-diones; and chromanols (e.g. tocopherol). Particularly preferred reducing agents are bisphenols and chromanols.

The reducing agent used in the present invention may be added in any form of aqueous solution, organic solvent solution, powder, solid microgram dispersion or emulsified dispersion. Dispersion of the solid microgram is effected using a known pulverizing means (e.g., ball mill, vibrating ball mill, sand mill, colloid mill, jet mill and roller mill). A dispersion aid may be available for dispersing the solid micrograin.

There is no specific limitation on the halogen composition of the photosensitive silver halide for use in the present invention, and examples of which include silver chloride, silver chlorobromide, silver bromide, silver iodobromide and silver iodochlorobromide. The grain formation of the photosensitive silver halide emulsion is described in the paragraphs [0217] to [0224] of JP-A-11-119374, while being not limited thereto.

Possible shapes of the silver halide grains include cubic, octahedron, tetradecahedron, tabular, spherical, rod and pebble. Cubic grains and tabular grains are particularly preferable in the present invention. Morphological characteristics of the grain, such as aspect ratio and plane index, are similar to those disclosed in the paragraph [0225] of JP-A-11-119374. The halogen composition distribution within the grain may be uniform, or the halogen composition may be changed stepwise or continuously. Silver halide grain with a core/shell structure may preferably be used, in which the structure thereof is preferably of two-fold to five-fold, and more preferably of two-fold to four-fold. It is also preferable to adopt a technique for localizing silver bromide on the surface of silver chloride or silver cholorobromide.

The grain size distribution of the silver halide grains for use in the present invention is expressed with a degree of monodispersion of 30% or below, more preferably 1 to 20%, and still more preferably 5 to 15%. The degree of monodispersion described herein is defined as a value obtained by dividing the standard deviation of the grain diameter by the volume weighted mean diameter and expressed in percentage (%: coefficient of variation). The grain diameter of the silver halide grains is now represented by length of edge for the cubic grain, and by a projected circle-equivalent diameter for other grains (octahedral, tetradecahedral, tabular or the like).

The photosensitive silver halide grains for use in the present invention contain a Group VII or Group VIII metal in the Periodic Table, or a complex of such metal. The Group VII or Group VIII metal in the Periodic Table, or a center metal of the metal complex is preferably rhodium, rhenium, ruthenium, osmium or iridium. Particularly preferable metal complexes include $(NH_4)_3Rh(H_2O)Cl_5$, $K_2Ru(NO)Cl_5$, $K_3IrCl_6$ and $K_4Fe(CN)_6$. These metal complexes may be used individually, or in combination of two or more complexes of the same metal or different metals. The metal complex content is preferably from $1\times10^{-9}$ to $1\times10^{-3}$ mol per mol of silver, and more preferably from $1\times10^{-8}$ to $1\times10^{-4}$ mol. With respect to the specific structure of the metal complexes, those having the structures described in JP-A-7-225449 may be used. Species and addition methods of these heavy metals are disclosed in the paragraphs [0227] to [0240] of JP-A-11-119374.

The photosensitive silver halide grains may be desalted by water washing according to a method known in the art, such as noodle washing and flocculation, while omission of the desalting being also allowable in the present invention.

The photosensitive silver halide emulsion for use in the present invention is preferably chemically sensitized. The chemical sensitization can be effected according to the method described in the paragraphs [0242] to [0250] of JP-A-11-119374. The silver halide emulsion for use in the present invention is preferably added with a thiosulfonic acid compound according to a method described in European Patent No. 293,917.

The gelatin contained in the photosensitive silver halide for use in the present invention is preferably a low-molecular-weight gelatin so as to maintain a desirable dispersion state of the photosensitive silver halide emulsion in the coating liquid of the organic acid silver salt grains. The molecular weight of the low-molecular-weight gelatin is within a range from 500 to 60,000, and more preferably from 1,000 to 40,000. The low-molecular-weight gelatin may be used during the grain formation or during the dispersion after desalting, where the latter being more preferable. It is also allowable to use a general gelatin (molecular weight of approx. 100,000) during the grain formation and use a low-molecular-weight gelatin during the dispersion after desalting.

The concentration of the dispersion medium is preferably 0.05 to 20 wt %, and more preferably 5 to 15 wt % from the viewpoint of handling property. Besides generally used alkali-treated gelatin, available are modified gelatins such as acid-treated gelatin and phthalized gelatin.

In the recording material used for the present invention, a single kind of silver halide emulsion may be used, or two or more kinds of silver halide emulsions (for example, those differ in the average grain size, halogen composition, crystal habit or chemical sensitization conditions) may be used in combination.

The amount of the photosensitive silver halide used in the present invention is preferably from 0.01 to 0.5 mol per one mol of the organic acid silver salt, more preferably from 0.02 to 0.3 mol, still more preferably from 0.03 to 0.25 mol. Methods for mixing photosensitive silver halide and organic acid silver salt separately prepared include such that mixing, after completion of the individual preparation, the silver halide grains and the organic acid silver salt in a high-speed stirrer, ball mill, sand mill, colloid mill, vibrating mill, homogenizer or the like; and such that mixing, at any timing during preparation of the organic acid silver salt, already-finished photosensitive silver halide to prepare the organic acid silver salt; while being not limited thereto so far as sufficient effects of the present invention are obtained. One preferable method for controlling photographic properties relates to mixing of two or more kinds of the water-base dispersions of the organic acid silver salt with two or more kinds of the water-base dispersions of the photosensitive silver salt.

As the binder for use in the image forming layer of the thermally processed image forming material of the present invention, polymer latex is preferable. Dispersion status, average grain size of the dispersed grains and grain size distribution are similar to those described for the foregoing outermost layers. The latex may be not only an ordinary uniform-structured one but also a so-called core/shell type latex. In some cases, it is preferred that the core and the shell have different glass transition points.

Examples of the polymer species of the polymer latex for use in the present invention include acrylic resin, vinyl acetate resin, polyester resin, polyurethane resin, rubber-base resin, vinyl chloride resin, vinylidene chloride resin, polyolefin resin and copolymers thereof. The polymer may be a straight-chained polymer, a branched polymer or a cross-linked polymer. The polymer may be a so-called homopolymer consisting of a single kind of monomer or may be a copolymer consisting of two or more kinds of monomers. Both of random copolymer and block copolymer are allowable as the copolymer. The polymer preferably has a number average molecular weight of from 5,000 to 1,000,000, and more preferably from 10,000 to 100,000. Too small molecular weight will result in poor mechanical strength of the image forming layer, whereas too large in undesirable film-forming property.

Specific examples of the polymer latex for use in the image forming layer of the thermally processed image forming material include methyl methacrylate/ethyl acrylate/methacrylic acid copolymer latex, methyl methacrylate/butadiene/itaconic acid copolymer latex, ethyl acrylate/methacrylic acid copolymer latex, methyl methacrylate/2-ethylhexyl acrylate/styrene/acrylic acid copolymer latex, styrene/butadiene/acrylic acid copolymer latex, styrene/butadiene/divinylbenzene/methacrylic acid copolymer latex, methyl methacrylate/vinyl chloride/acrylic acid copolymer latex, and vinylidene chloride/ethyl acrylate/acrylonitrile/methacrylic acid copolymer latex. More specifically, examples of which include copolymer latex expressed by methyl methacrylate/ethyl acrylate/methacrylic acid=33.5/50/16.5 (wt %), copolymer latex expressed by methyl methacrylate/butadiene/itaconic acid=47.5/47.5/5 (wt %), and copolymer latex expressed by ethyl acrylate/methacrylic acid=95/5 (wt %). Such polymers are also commercially available, which include acrylic resins such as CEBIAN A-4635, 46583 and 4601 (all produced by Dicel Chemical Industries, Ltd.) and Nipol Lx811, 814, 821, 820, 857 (all produced by Nippon Zeon KK); polyester resins such as FINETEX ES650, 611, 675, 850 (all produced by Dai-Nippon Ink & Chemicals, Inc.), WD-size and WMS (both produced by Eastman Chemical); polyurethane resins such as HYDRAN AP10, 20, 30, 40 (all produced by Dai-Nippon Ink & Chemicals, Inc.); rubber-based resins such as LACSTAR 7310K, 3307B, 4700H, 7132C (all produced by Dai-Nippon Ink & Chemicals, Inc.), Nipol Lx410, 430, 435, 438C (all produced by Nippon Zeon KK); vinyl chloride resins such as G351, G576 (both produced by Nippon Zeon KK); vinylidene chloride resins such as L502, L513 (both produced by Asahi Chemical Industry Co., Ltd.), ARON D7020, D504 and D5071 (all produced by Mitsui Chemical Co., Ltd.); and olefin resins such as CHEMIPEARL S120 and SA100 (both produced by Mitsui Chemical Co., Ltd.). These polymers may be used individually or, as required, as a blend of two or more species.

Preferable range of the glass transition point (Tg) of the polymer latex preferably used as the binder in the present invention will differ according to its use for the protective layer, back layer or image forming layer. For use in the image forming layer, the glass transition point is preferably be selected from −30 to 40° C. so as to promote the diffusion of the photographically useful material during the heat development.

The polymer latex for use in the present invention preferably has a minimum film-forming temperature (MFT) of from −30 to 90° C., more preferably from 0 to 70° C. In order to control the MFT, a filming aid may be added. The filming aid, also called a plasticizer, refers to an organic compound (usually an organic solvent) capable of lowering the MFT of the polymer latex, which is described in "Gosei Latex no Kagaku (Chemistry of Synthetic Latex)", by Souichi Muroi, issued by Kobunshi Kanko Kai (1970), supra.

The amount of the total binder in the image forming layer is preferably 0.2 to 30 g/m$^2$, and more preferably 1 to 15 g/m$^2$. In the image forming layer, the polymer latex preferably accounts for 50 wt % or more of the total binder, and more preferably 70 wt % or more. For the case that the image forming layer comprises two or more layers stacked with each other, the polymer latex preferably accounts for 50 wt % or more of the total binder of at least one layer.

It is preferable in the present invention that the image forming layer is formed by coating a water-base liquid, which is followed by drying. Here, "water-bases" described herein refers to that water accounts for 60 wt % or more of the solvent (dispersion medium) of the coating liquid. Possible component of the coating liquid other than water may be water-miscible organic solvent such as methanol, ethanol, isopropanol, Methyl Cellosolve, Ethyl Cellosolve, dimethylformamide and ethyl acetate. Specific examples of the solvent composition include water/methanol=90/10, water/methanol=70/30, water/ethanol=90/10, water/isopropanol=90/10, water/dimethylformamide=95/5, water/methanol/dimethylformamide=80/15/5 and water/methanol/dimethylformamide=90/5/5 (the numerals are in wt %).

The thermally processed image forming material of the present invention has on only one side of a support an image forming layer, where it is preferable that at least one protective layer is provided on the image forming layer. It is also preferable that the thermally processed image forming material of the present invention has at least one back layer on the other side of the support and opposite to the image forming layer. Polymer latex is used as a binder for the image forming layer, protective layer and back layer. Using the polymer latex for such layers allows water-base coating using a solvent (dispersion medium) containing water as a major component, which is advantageous from environmental and economical viewpoints and in obtaining a thermally processed image forming material causing no wrinkle during the heat development. Using a support preliminarily subjected to a predetermined heat processing will yield a thermally processed image forming material less in dimensional changes before and after the heat development.

As a binder in the layer other than the outermost layer is preferably the polymer latex used for the foregoing image forming layer. The polymer latex can be used not only for the image forming layer, but also for the protective layer and back layer. Using the polymer latex for the protective layer and back layer is favorable when the thermally processed image forming material of the present invention is applied to printing where dimensional variation is noted as a critical issue.

Preferable range of the glass transition point ($T_g$) of the polymer latex preferably used as the binder will differ according to its use for the protective layer, back layer or image forming layer. For use in the image forming layer, the glass transition point is preferably be selected from −30 to 40° C. so as to promote the diffusion of the photographically useful material during the heat development, as described above. For use in the protective layer and the back layer, the glass transition point is preferably 25 to 70° C., since these layers will come into contact with various apparatuses.

A combination of polymer latexes with different I/O values is preferably used as a binder for the protective layer, where the I/O value is defined as an inorganicity value divided by an organicity value, both values being found in a conceptional organicity chart described in the paragraphs [0025] to [0029] of Japanese Patent Application No. 11-6872.

The amount of total binder in the protective layer in the present invention is preferably 0.2 to 10.0 g/m$^2$, and more preferably 0.5 to 6.0 g/m$^2$.

The amount of total binder in the back layer in the present invention is preferably 0.01 to 10.0 g/m$^2$, and more preferably 0.05 to 5.0 g/m$^2$.

In some cases, the image forming layer, protective layer and back layer are individually provided in numbers of two or more. For the case that two or more image forming layer are provided, it is preferable to use the polymer latex for the binder of all layers. The protective layer is provided, sometimes in two or more layers, on the image forming layer, in which it is preferable to use the polymer latex at least in one protective layer, and in particular in the outermost one. The back layer is provided, sometimes in two or more layers, on the undercoated layer on the rear surface of the substrate, in which it is preferable to use the polymer latex at least in one back layer, and in particular in the outermost one.

The thermally processed image forming material of the present invention allows various additives to be added.

A sensitization dye available for the thermally processed image forming material of the present invention is such that being capable of spectrally sensitizing silver halide grains within a predetermined wavelength range upon adsorbing on such silver halide grains. It is advantageous to select a sensitization dye having a spectral sensitivity well matched to the spectral characteristic of an exposure light source to be used. For example, a dye showing spectral sensitization in a range from 550 to 750 nm is expressed by the general formula (II) of JP-A-10-186572, and is enumerated as Compounds II-6, II-7, II-14, II-15, II-18, II-23 and II-25. Another dye showing spectral sensitization in a range of 750 to 1400 nm is expressed by the general formula (I) of JP-A-11-119374, and is enumerated as Compounds (25), (26), (30), (32), (36), (37), (41), (49) and (54). Dyes forming J-band have been disclosed in U.S. Pat. Nos. 5,510,236 and 3,871,887 (Example 5), JP-A-2-96131 and JP-A-59-48753. These dyes may be used individually or in combination of two or more thereof.

A method of addition of the sensitization dye can be found in the paragraph [0106] of JP-A-11-119374, while being not limited thereto.

The amount of addition of the sensitization dye used in the present invention may be selected according to the performance such as sensitivity or fog; where it is preferably from $10^{-6}$ to 1 mol per mol of silver halide in the photosensitive layer, and more preferably from $10^{-4}$ to $10^{-1}$ mol.

In the thermally processed image forming material of the present invention, a supersensitizer can be used for improving spectral sensitization efficiency. Examples of the supersensitizer available in the present invention include compounds disclosed in European Patent No. 587,338, U.S. Pat. Nos. 3,877,943 and 4,873,184; heteroaromatic or aliphatic mercapto compounds; heteroaromatic disulfide compounds; stilbene, hydrazine and triazine.

Particularly preferable supersensitizer include a heteroaromatic mercapto compound disclosed in JP-A-5-341432; heteroaromatic disulfide compounds; compounds expressed by the general formula (I) and (II) of JP-A-4-182639; a stilbene compound expressed by the general formula (I) of JP-A-10-111543; and a compound expressed by the general formula (I) of JP-A-11-109547. More specifically, they include Compounds M-1 to M-24 of JP-A-5-341432; Compounds d-1) to d-14) of JP-A-4-182639; Compounds SS-01 to SS-07 or JP-A-10-111543; and Compounds 31, 32, 37, 38 41 to 45 and 51 to 53 of JP-A-11-109547.

The amount of addition of such supersensitizer is preferably $10^{-4}$ to 1 mol per mol of silver halide in the image forming layer, and more preferably 0.001 to 0.3 mol.

Next, the nucleation aid used for the thermally processed image forming material will be described. While there is no specific limitation on the species of the nucleation aid, preferable is a hydrazine derivative expressed by the general formula (H) of Japanese Patent Application No. 11-87297 and more specifically hydrazine derivatives listed in Tables 1 to 4 of the same specification. Other hydrazine derivatives are disclosed in JP-A-10-10672, JP-A-10-161270, JP-A-10-62898, JP-A-9-304870, JP-A-9-304872, JP-A-9-304871, JP-A-10-31282, U.S. Pat. No. 5,496,695 and European Patent No. 741,320A. Other examples include substituted alkene derivatives, substituted isooxazole derivatives and specific acetal compound expressed by the general formulae (1) to (3) of JP-A-11-87297, and more preferably cyclic compounds expressed by the formulae (A) and (B) of the same specification and still more specifically Compounds 1 to 72 expressed by the formulae (8) to (12) of the same specification. These nucleation aids may be used individually or in combination of two or more thereof.

The foregoing nucleation aid can be used in the present invention as dissolved in water or other appropriate organic solvents such as alcohols (methanol, ethanol, propanol, fluorinated alcohol), ketones (acetone, methyl ethyl ketone), dimethylformamide, dimethylsulfoxide and Methyl Cellosolve.

The nucleation aid can also be used in a form of emulsified dispersion obtained mechanically by the well-known emulsifying dispersion method by which the compounds are dissolved in oil such as dibutyl phthalate, tricresyl phosphate, glyceryl triacetate and diethyl phthalate; or in auxiliary solvent such as ethyl acetate and cyclohexanone. Alternative method relates to the solid dispersion method by which powder of the nucleation aid is dispersed into water with aid of a ball mill, colloid mill or ultrasonic wave.

The nucleation aid can be added to the image forming layer or any other layer, where addition to the image forming layer or to the layer adjacent thereto is preferable.

The nucleation aid are preferably used in an amount from $1\times10^{-6}$ to 1 mol per mol of silver, and more preferably from $1\times10^{-5}$ to $5\times10^{-1}$ mol, and still more preferably from $2\times10^{-5}$ to $2\times10^{-1}$ mol.

Besides the compounds listed above, it is also allowable to use the compounds disclosed in U.S. Pat. Nos. 5,545,515, 5,635,339, 5,654,130, International Patent Publication WO 97/34196, U.S. Pat. No. 5,686,228, JP-A-11-119372, Japanese Patent Application No. 9-309813, JP-A-11-95365, JP-A-11-95366, and Japanese Patent Application No. 9-332388.

In the thermally processed image forming material of the present invention, a contrast accelerator may be used in combination with the above-described nucleation aid so as to produce an ultrahigh contrast image. Examples thereof include amine compounds described in U.S. Pat. No. 5,545,505, specifically, Compounds AM-1 to AM-5; hydroxamic acids described in U.S. Pat. No. 5,545,507, specifically, Compounds HA-1 to HA-11; acrylonitriles described in U.S. Pat. No. 5,545,507, specifically, Compounds CN-1 to CN-13; hydrazine compounds described in U.S. Pat. No. 5,558,983, specifically, Compounds CA-1 to CA-6; and onium salts described in JP-A-9-297368, specifically, Compounds A-1 to A-42, B-1 to B-27 and C-1 to C-14.

For the thermally processed image forming material of the present invention, it is preferable to use, in combined with the nucleation aid, an acid produced by hydration of phosphorus pentoxide or a salt thereof. An acid produced by hydration of phosphorus pentoxide or a salt thereof include metaphosphoric acid (metaphosphate), pyrophosphoric acid (pyrophosphate), orthophosphoric acid (orthophosphate), triphosphoric acid (triphosphate), tetraphosphoric acid (tetraphosphate), and hexametaphosphoric acid (hexametaphosphate); among which orthophosphoric acid (orthophosphate) and hexametaphosphoric acid (hexametaphosphate) being more preferable. The salts are specified as sodium orthophosphate, sodium dihydrogenorthophosphate, sodium hexametaphosphate and ammonium hexametaphosphate.

An acid produced by hydration of phosphorus pentoxide or a salt thereof preferably used in the present invention is added to the image forming layer or the adjacent binder-containing layer in terms of exhibiting a desired effect in a minimum amount of use.

While the amount of use (the amount of coating per $m^2$ of the image recording material) of an acid produced by hydration of phosphorus pentoxide or a salt thereof can be a desired amount considering the properties such as sensitivity and fog, a preferable amount resides in a range from 0.1 to 500 $mg/m^2$, and more preferably 0.5 to 100 $mg/m^2$.

In the thermally processed image forming material of the present invention, a phenol derivative expressed by the general formula (A) of Japanese Patent Application No. 11-73951 is preferably used as a development accelerator. The phenol derivative expressed by the general formula (A) can exhibit a strong development accelerating effect when used in combination with the foregoing reducing agent. Preferable examples are specified as Compounds A-1 to A-54 in the same specification. The phenol derivative expressed by the general formula (A) is used in an amount of 0.01 to 100 mol % with respect to the reducing agent, and more preferably 0.1 to 20 mol %.

The phenol derivative expressed by the general formula (A) can be added to the image forming layer or any other layer provided on the same side therewith as viewed from a support, where addition to a layer containing the reducing agent is preferable. The phenol derivative expressed by the general formula (A) used in the present invention may be added in any form of aqueous solution, organic solvent solution, powder, solid microgram dispersion or emulsified dispersion. Dispersion of the solid microgram is effected using a known pulverizing means (e.g., ball mill, vibrating ball mill, sand mill, colloid mill, jet mill and roller mill). A dispersion aid may be available for dispersing the solid microgram.

Using an additive known as a toning agent may sometimes raise the optical density. In some cases the toning agent is even advantageous in forming a blackened silver image. The toning agent is preferably contained in elsewhere on the side having the image forming layer in an amount of 0.1 to 50 mol % per mol of silver, and more preferably 0.5 to 20 mol %. The toning agent may also be a so-called precursor which is derived to effectively exhibit its function only at the time of development.

For use in the thermally processed image forming material using the organic acid silver salt, a wide variety of the toning agents are disclosed, for example, in JP-A-46-6071, JP-A-47-10282, JP-A-49-5019, JP-A-49-5020, JP-A-49-91215, JP-A-50-2524, JP-A-50-32927, JP-A-50-67132, JP-A-50-67641, JP-A-50-114217, JP-A-51-3223, JP-A-51-27923, JP-A-52-14788, JP-A-52-99813, JP-A-53-1020, JP-A-53-76020, JP-A-54-156524, JP-A-54-156525, JP-A-61-183642, JP-A-4-56848, JP-B-49-10727 (the code "JP-B" as used herein means an "examined Japanese Patent Publication"), JP-B-54-20333, U.S. Pat. Nos. 3,080,254, 3,446,648, 3,782,941, 4,123,282 and 4,510,236, British Patent No. 1,380,795 and Belgian Patent No. 841,910. Examples of the toning agent include phthalimide and N-hydroxyphthalimide; cyclic imides such as succinimide, pyrazoline-5-one, quinazolinone, 3-phenyl-2-pyrazoline-5-one, 1-phenylurazole, quinazoline and 2,4-thiazolinedione; naphthalimide (e.g., N-hydroxyl-1,8-naphthalimide); cobalt complex (e.g., cobalthexamine trifluoroacetate); mercaptans such as 3-mercapto-1,2,4-triazole, 2,4-dimercaptopyrimidine, 3-mercapto-4,5-diphenyl-1,2,4-triazole and 2,5-dimercapto-1,3,4-thiadiazole; N-(aminomethyl)aryldicarboxyimide (e.g., N,N-(dimethylaminomethyl)phthalimide and N,N-(dimethylaminomethyl)naphthalene-2,3-dicarboxyimide); blocked pyrazole, isothiuronium derivatives and a certain kind of photofading agent [e.g., N,N'-hexamethylenebis(1-carbamoyl-3,5-dimethylpyrazole, 1,8-(3,6-diazaoctane)bis(isothiuronium trifluoroacetate) and 2-tribromomethylsulfonyl)benzothiazole]; 3-ethyl-5-[(3-ethyl-2-benzothiazolinilidene)-1-methylethylidene]-2-thio-2,4-oxazolidinedione; phthalazinone, phthalazinone derivatives or metal salts; or the derivatives such as 4-(1-naphthyl)phthalazinone, 6-chlorophthalazinone, 5,7-dimethoxyphthalazinone or 2,3-dihydro-1,4-phthalazinedione; combinations of phthalazinone and phthalic acid derivatives (e.g., phthalic acid, 4-methyltphthalic acid, 4-nitrophthalic acid and tetrachlorophthalic anhydride); phthalazines, phthalazine derivatives [e.g., 4-(1-naphthyl)phthalazine, 6-chlorophthalazine, 5,7-dimethoxyphthalazine, 6-iso-butylphthalazine, 6-tert-butylphthalazine, 5,7-dimethylphthalazine and 2,3-dihydrophthalazine]or metal salts; combinations of phthalazine and phthalic acid derivatives (e.g., phthalic acid, 4-methyltphthalic acid, 4-nitrophthalic acid and tetrachlorophthalic anhydride); quinazolinedione, benzoxazine or natphthoxazine derivatives; rhodium complex serves, not only functions as a toning agent, but also as an in situ halide ion source for producing silver halide, such as ammonium hexachlororhodate (III), rhodium bromide, rhodium nitrate and potassium hexachlororhodate (III); inorganic peroxides and persulfates such as ammonium disulfide peroxide and hydrogen peroxide; benzoxazine-2,4-diones such as 1,3-benzoxazine-2,4-dione, 8-methyl-1,3-benzoxazine-2,4-dione and 6-nitro-1,3-benzoxazine-2,4-dione; pyrimidines and asymmetric triazine (e.g., 2,4-dihydroxypyrimidine and 2-hydroxy-4-aminopyrimidine); azauracil; and tetraazapentalene derivatives (e.g., 3,6-dimercapto-1,4-diphenyl-1H,4H-2,3a,5,6a-tetraazapentalene and 1,4-di(o-chlorophenyl)-3,6-dimercapto-1H,4H-2,3a,5,6a-tetraazapentalene).

In the present invention, a phthalazine derivative expressed by the general formula (F) of JP-A-2000-35631 is preferably used as a toning agent. Preferable examples are specified as Compounds A-1 to A-10 in the same specification.

The toning agent may be added in any form of solution, powder or solid microgram dispersion. Dispersion of the solid microgram is effected using a known pulverizing means (e.g., ball mill, vibrating ball mill, sand mill, colloid mill, jet mill and roller mill). A dispersion aid may be available for dispersing the solid microgram.

The silver halide emulsion and/or organic acid silver salt for use in the present invention can successfully be prevented, by addition of antifoggant, stabilizer or stabilizer precursor, from additional fogging and from lowered sensitivity during the stock storage. Appropriate examples of antifoggant, stabilizers and stabilizer precursors, available individually or in combination, include thiazonium salts described in U.S. Pat. Nos. 2,131,038 and 2,694,716; azaindenes described in U.S. Pat. Nos. 2,886,437 and 2,444,605; mercury salts described in U.S. Pat. No. 2,728,663; urazoles described in U.S. Pat. No. 3,287,135; sulfocatechol described in U.S. Pat. No. 3,235,652; oximes, nitrons and nitroindazoles described in British Patent No. 623,448; polyvalent metal salts described in U.S. Pat. No. 2,839,405; thiuronium salts described in U.S. Pat. No. 3,220,839; palladium, platinum and gold salts described in U.S. Pat. Nos. 2,566,263 and 2,597,915; halogen-substituted organic compounds described in U.S. Pat. Nos. 4,108,665 and 4,442,202; triazines described in U.S. Pat. Nos. 4,128,557, 4,137,079, 4,138,365 and 4,459,350; and phosphorus compounds described in U.S. Pat. No. 4,411,985.

The thermally processed image forming material of the present invention may contain a benzoic acids for improving the sensitivity and for preventing fog. Any kind of benzoic acid derivatives are available for the present invention, where preferred examples of the structure include those described in U.S. Pat. Nos. 4,784,939 and 4,152,160 and JP-A-9-329863, JP-A-9-329864 and JP-A-9-281637. Although the benzoic acid for use in the present invention may be added to any portion of the photosensitive material, addition to a layer provided on the same side with the photosensitive layer is preferable, and to a layer containing the organic acid silver salt is more preferable. The benzoic acids may be added at any step during the preparation of the coating liquid. In the case of addition to the layer containing the organic acid silver salt, the benzoic acids may be added at any step within a period from the preparation of the organic acid silver salt to the preparation of the coating liquid, where addition in a period following the preparation of the organic acid silver salt and immediately before the coating is preferable. The benzoic acids may be added in any form of solution, powder or solid microgram dispersion. It is also allowable to add the benzoic acids in a form of mixed solution containing other additives such as a sensitizing dye, reducing agent and toning agent. The amount of addition of the benzoic acids can arbitrarily be selected, where a preferable range being from $1\times10^{-6}$ to 2 mol per mol of silver, and more preferably from $1\times10^{-3}$ to 0.5 mol.

While being not essential in the thermally processed image forming material of the present invention, it is advantageous in some cases to add a mercury(II) salt as an antifoggant to the emulsion layer. Preferred mercury(II) salts for this purpose are mercury acetate and mercury bromide. The amount of addition of mercury for use in the present invention is preferably from $1\times10^{-9}$ to $1\times-3$ per mol of silver coated, and more preferably from $1\times10^{-8}$ to $1\times10^{-4}$ mol.

An antifoggant which is most preferably used in the present invention is organic halide, and the typical examples thereof are disclosed in JP-A-50-119624, JP-A-50-120328, JP-A-51-121332, JP-A-54-58022, JP-A-56-70543, JP-A-56-99335, JP-A-59-90842, JP-A-61-129642, JP-A-62-129845, JP-A-6-208191, JP-A-7-5621, JP-A-7-2781, JP-A-8-15809 and U.S. Pat. Nos. 5,340,712, 5,369,000 and 5,464,737.

An example of the preferable antifoggant is typically disclosed as a hydrophilic organic halide as expressed by the general formula (P) of Japanese Patent Application No. 11-87297, specific examples thereof being Compounds (P-1) to (P-118) listed in the same specification.

The amount of addition of the organic halide, as expressed in a molar amount per mol of silver (mol/mol Ag), is preferably $1\times10^{-5}$ to 2 mol/mol Ag, more preferably $5\times10^{-5}$ to 1 mol/mol Ag, and still more preferably $1\times10^{-4}$ to $5\times10^{-1}$ mol/mol Ag. These compounds may be used individually, or in combination of two or more species.

A salicylic acid derivative expressed by the general formula (Z) of Japanese Patent Application No. 11-87297 is also a preferable antifoggant, which is specified as Compounds (A-1) to (A-60) in the same specification. The amount of addition of the salicylic acid derivative expressed by the general formula (Z), as expressed in a molar amount per mol of silver (mol/mol Ag), is preferably $1\times10^{-5}$ to $5\times10^{-1}$ mol/mol Ag, more preferably $5\times10^{-5}$ to $1\times10^{-1}$ mol/mol Ag, and still more preferably $1\times10^{-4}$ to $5\times10^{-2}$ mol/mol Ag. These compounds may be used individually, or in combination of two or more species.

Formalin scavenger is an effective antifoggant for use in the present invention. This is typically expressed by the formula (S) of Japanese Patent Application No. 11-23995 and is specified as Compounds (S-1) to (S-24).

The antifoggant for use in the present invention can be used as dissolved in water or other appropriate organic solvents such as alcohols (methanol, ethanol, propanol, fluorinated alcohol), ketones (acetone, methyl ethyl ketone), dimethylformamide, dimethylsulfoxide and Methyl Cellosolve.

The antifoggant can also be used in a form of emulsified dispersion obtained mechanically by the well-known emulsifying dispersion method by which the compounds are dissolved in oil such as dibutyl phthalate, tricresyl phosphate, glyceryl triacetate and diethyl phthalate; or in auxiliary solvent such as ethyl acetate and cyclohexanone. Alternative method relates to the solid dispersion method by which powders of the compounds are dispersed into water with aid of a ball mill, colloid mill, sand grinder mill, mantone galling, microfluidizer or ultrasonic wave.

The antifoggant can be added to the image forming layer or any other layer provided on the same side therewith as viewed from a support, where addition to the image forming layer or the adjacent layer is preferable. The image forming layer refers to a layer containing a reducible silver salt (organic acid silver salt), and more preferably to a layer further containing a photosensitive silver halide.

In the photothermographic material containing a non-photosensitive silver salt, a photosensitive silver halide and a binder, formic acid or formate can act as a strong foggant. Thus in the present invention, the content of formic acid or formate in any layer on the same side with the image forming layer containing the photosensitive silver halide is preferably 5 mmol or below per mol of silver, and more preferably 1 mmol or below.

The thermally processed image forming material of the present invention may contain mercapto compound, disulfide compound or thione compound so as to control the development by inhibiting or accelerating thereof, or to improve the storage stability before and after the development.

While any structure of mercapto compound may be available in the present invention, such that expressed by Ar—SM or Ar—S—S—Ar is preferable, wherein M represents a hydrogen atom or alkali metal atom; and Ar represents an aromatic ring or condensed aromatic ring containing one or more nitrogen, sulfur, oxygen, selenium or tellurium atoms. Preferable heteroaromatic rings include benzimidazole, naphthimidazole, benzothiazole, naphthothiazole, benzoxazole, naphthoxazole, benzoselenazole, benzotellurazole, imidazole, oxazole, pyrazole, triazole, thiadiazole, tetrazole, triazine, pyrimidine, pyridazine, pyrazine, pyridine, purine, quinoline and quinazolinone. The heteroaromatic ring may have a substituent selected from, for example, the group consisting of halogen (e.g., Br, Cl), hydroxyl, amino, carboxyl, alkyl (e.g., those having one or more carbon atoms, preferably from 1 to 4 carbon atoms), alkoxy (e.g., those having one or more carbon atoms, preferably from 1 to 4 carbon atoms) and aryl (which may also be substituted). Examples of the mercapto-substituted heteroaromatic compound include 2-mercaptobenzimidazole, 2-mercaptobenzoxazole, 2-mercaptobenzothiazole, 2-mercapto-5-methylbenzimidazole, 6-ethoxy-2-mercaptobenzothiazole, 2,2'-dithiobis(benzothiazole), 3-mercapto-1,2,4-triazole, 4,5-diphenyl-2-imidazolethiol, 2-mercaptoimidazole, 1-ethyl-2-mercaptobenzimidazole, 2-mercaptoquinoline, 8-mercaptopurine, 2-mercapto-4(3H)-quinazolinone, 7-trifluoromethyl-4-quinolinethiol, 2,3,5,6-tetrachloro-4-pyridinethiol, 4-amino-6-hydroxy-2-mercaptopyrimidine monohydrate, 2-amino-5-mercapto-1,3,4-thiadiazole, 3-amino-5-mercapto-1,2,4-triazole, 4-hydroxy-2-mercaptopyrimidine, 2-mercaptopyrimidine, 4,6-diamino-2-mercaptopyrimidine, 2-mercapto-4-methylpyrimidine hydrochloride, 3-mercapto-5-phenyl-1,2,4-triazole, 1-phenyl-5-mercaptotetrazole, sodium 3-(5-mercaptotetrazole)benzenesulfonate; N-methyl-N'-[3-(5-mercaptotetrazolyl)phenyl]urea, and 2-mercapto-4-phenyloxazole, while being not particularly limited thereto. The amount of the addition of the mercapto compounds, as expressed in an amount per mol of silver in the image forming layer, is preferably from 0.0001 to 1.0 mol per one mol of silver, more preferably from 0.001 to 0.3 mol.

To the image forming layer of the thermally processed image forming material of the present invention, it is allowable to add, as required, hydrophilic polymer such as gelatin, polyvinyl alcohol, methylcellulose, hydroxypropylcellulose, carboxymethylcellulose, and hydroxypropylmethylcellulose. The amount of addition of these hydrophilic polymers is preferably 30 wt % or less of the total binder of the image forming layer, and more preferably 15 wt % or less.

In the fabrication of the thermally processed image forming material of the present invention, it is allowable to add, as required, plasticizers (e.g., benzyl alcohol and 2,2,4-trimethylpentanediol-1,3-monoisobutylate) described the paragraphs [0021] to [00251] of Japanese Patent Application No. 11-143058 to control the film forming temperature. It is also allowable to add a hydrophilic polymer into a polymer binder and add a water-miscible organic solvent into a coating liquid as disclosed in the paragraphs [0027] to [0028] of Japanese Patent Application No. 11-6872.

It is also allowable to form the individual layers using a first polymer latex being introduced with a functional group described in the paragraphs [0023] to [0041] of JP-A-2000-19678, together with a crosslinking agent and/or a second polymer latex having a functional group capable of reacting with the first polymer latex.

Examples of such functional group include carboxyl group, hydroxyl group, isocyanate group, epoxy group, N-methylol group and oxazolinyl group; and examples of such crosslinking agent include epoxy compounds, isocyanate compounds, block isocyanate compounds, methylol compounds, hydroxyl compounds, carboxyl compounds, amino compounds, ethyleneimine compounds, aldehyde compounds and halogen compounds. More specifically, examples of the crosslinking agent include isocyanate compounds such as hexamethylene isocyanate, Duranate B40-80D, WX-1741 (products of Asahi Chemical), Bayhidur 3100 (Sumitomo Bayer Urethane Co., Ltd.), Takenate WD725 (Takeda Chemical Industries, Ltd.), Aquanate 100, 200 (Nippon Polyurethane Industry Co., Ltd.), and water-dispersed polyisocyanate disclosed in JP-A-9-160172; amino compound such as Sumitex Resin M-3 (Sumitomo Chemical); epoxy compound such as Denacol EX-614B (Nagase Chemicals, Ltd.); and halogern compound such as sodium 2,4-dichloro-6-hydroxy-1,3,5-triazine.

The thermally processed image forming material of the present invention may be subjected to antistatic treatment in order to reduce dust adhesion, to prevent static mark from generating, and to avoid conveyance failure in an automatic conveying process, the antistatic treatment being effected with an electro-conductive metal oxide and/or fluorine-containing surfactant disclosed in the paragraphs from [0040] to [0051] of JP-A-11-84573. Preferable examples of the electro-conductive metal oxide include an antimony-doped acicular electro-conductive stannic oxide disclosed in U.S. Pat. No. 5,575,957 and the paragraphs from [0012] to [0020] of JP-A-11-223901; and an antimony-doped fibrous stannic oxide disclosed in JP-A-4-29134.

The surface specific resistivity (surface resistivity) of a layer containing such metal oxide is $10^{12}\Omega$ or below, and more preferably $10^{11}\Omega$ or below in an atmosphere of 25° C., 20% RH (relative humidity), which ensures an excellent antistatic property. A lower limit of the surface resistivity is $10^{7}\Omega$ or around in general, while being not limited specifically.

In the thermally processed image forming material of the present invention, it is preferable to use a water-soluble polymer as a thickening agent to improve the coating property, where both of natural and synthetic polymers are acceptable. Natural polymers include starches (e.g., corn starch, starch), seaweed (agar, sodium arginate), vegetative tacky substance (gum arabic), animal protein (glue, casein, gelatin, egg albumen) and fermented tacky substance (e.g., pullulan, dextrin); semisynthetic polymers include starchy material (e.g., solubilized starch, carboxyl starch, dextran) and cellulosic material (e.g., viscose, methyl cellulose, ethyl cellulose, carboxymethyl cellulose, hydroxyethyl cellulose, hydroxypropyl cellulose, hydroxypropylmethyl cellulose); and synthetic polymers (e.g., polyvinyl alcohol, polyacrylamide, polyvinyl pyrrolidone, polyethylene glycol, polypropylene glycol, polyvinyl ether, polyethylene imine, polystyrenesulfonic acid or copolymer thereof, polyvinyl sulfanic acid or copolymer thereof, polyacrylic acid or copolymer thereof, acrylic acid or copolymer thereof, maleic acid copolymer, maleic acid monoester copolymer, acryloylmethylpropanesulfonic acid or copolymer thereof).

Among such water-soluble polymers preferably available are sodium arginate, gelatin, dextran, dextrin, methyl cellulose, carboxymethyl cellulose, hydroxyethyl cellulose, hydroxypropyl cellulose, polyvinyl alcohol, polyacrylamide, polyvinyl pyrrolidone, polyethylene glycol, polypropylene glycol, polystyrenesulfonic acid or copolymer thereof, polyacrylic acid or copolymer thereof, maleic acid monoester copolymer and acryloylmethylpropanesulfonic acid or copolymer thereof, all of which being preferably used as a thickener.

Particularly preferable examples of which include gelatin, dextran, methyl cellulose, carboxymethyl cellulose, hydroxyethyl cellulose, polyvinyl alcohol, polyacrylamide, polyvinyl pyrrolidone, polystyrenesulfonic acid or copolymer thereof, polyacrylic acid or copolymer thereof and maleic acid monoester copolymer. These compounds are detailed in "Shin Suiyousei Porima no Oyo to Shijo (New Edition: Applications and Market of Water-Soluble Polymers), published by CMC, edited by Shinji Nagatomo, issued on Nov. 4, 1988).

The amount of addition of the water-soluble polymer as a thickener is not limitative so far as it can raise the viscosity of the coating liquid when added thereto. In general, the concentration in the liquid is in a range from 0.01 to 30 wt %, more preferably 0.05 to 20 wt %, and still more preferably 0.1 to 10 wt %. The viscosity achieved by addition of the polymer is preferably such that higher than the initial viscosity by $1\times10^{-3}$ Pa.s to $200\times10^{-3}$ Pa.s, and more preferably $5\times10^{-3}$ Pa.s to $100\times10^{-3}$ Pa.s. The measurement values described herein are those obtained from measurement using a B-type rotary viscometer at 25° C. For the case of addition of a thickener to the coating liquid or so, it is generally preferable to add the thickener in a form of solution diluted as possible. It is also preferable to keep vigorous stirring during the addition.

Next, surfactants available for the thermally processed image forming material of the present invention will be described. For the present invention, the surfactants can be classified by purpose of use such as dispersion aid, coating aid, wetting agent, antistatic agent and control agent for photographic property, and such purposes will be attained by properly using the surfactants listed below. The surfactants available in the present invention are of nonionic and ionic (anion, cation, betaine). Also fluorine-containing surfactant is preferably used.

Preferable nonionic surfactants include those having polyoxyethylene, polyoxypropylene, polyoxybutylene, polyglycidyl or sorbitan as a nonionic hydrophilic group, which are specified as polyoxyethylenealkyl ether, polyoxyethylenealkyl phenyl ether, polyoxyethylene-polyoxypropylene glycol, polyvalent alcohol fatty acid partial ester, polyoxyethylene polyvalent alcohol fatty acid partial ester, polyoxyethylene fatty acid ester, polyglyceline fatty acid ester, fatty acid diethanolamide and triethanolamine fatty acid partial ester.

Anionic surfactants include carboxylate, sulfate, sulfonate and phosphoric ester salt; and more specifically, fatty acid salt, alkylbenzenesulfonate, alkylnaphthalenesulfonate, alkylsulfonate, α-olefinsulfonate, dialkylsulfosuccinate, α-sulfonated fatty acid salt, N-methyl-N-oleyltaurine, petroleum sulfonate, alkylsulfate, sulfated oils and fats, polyoxyethylene alkyl ether sulfate, polyoxyethylene alkyl phenyl ether sulfate, polyoxyethylene styrenized phenyl ether sulfate, alkylphosphate, polyoxyethylene alkylether phosphate and naphthalenesulfonate-formaldehyde condensate.

Cationic surfactants include amine salt, quaternary ammonium salt and pyridinium salt; and more specifically, primary to tertiary aliphatic amine salts and quaternary ammonium salt (tetraalkyl ammonium salt, trialkylbenzyl ammonium salt, alkylpyridinium salt, alkylimidazolium salt).

Betaine-series surfactants include calboxy betaine and sulfobetaine, and more specifically, N-trialkyl-N-carboxymethylammonium betaine and N-trialkyl-N-sulfoalkyleneammonium betaine.

These surfactants are described in "Kaimen Kasseizai no Oyo (Applications of Surfactants)", written by Takao Karume, published by Saiwai Shobo, Sep. 1, 1980. The amount of use of the preferable surfactants is not limitative so far as they can exert a desired surface activation property.

Specific examples of the surfactants are listed below, while the surfactants available in the present invention are by no means limited thereto (where —$C_6H_4$— represents a phenylene group).

WA-1: $C_{16}H_{33}(OCH_2CH_2)_{10}OH$
WA-2: $C_9H_{19}$—$C_6H_4$—$(OCH_2CH_2)_{12}OH$
WA-3: sodium dodecylbenzenesulfonate
WA-4: sodium tri(isopropyl)naphthalenesulfonate
WA-5: sodium tri(isobutyl)naphthalenesulfonate
WA-6: sodium dodecylsulfate
WA-7: α-sulfasuccinic acid di(2-ethylhexyl) ester sodium salt
WA-8: $C_8H_{17}$—$C_6H_4$—$(CH_2CH_2O)_3(CH_2)_2SO_3K$
WA-10: cetyl trimethylammonium chloride
WA-11: $C_{11}H_{23}CONHCH_2CH_2N^{(+)}(CH_3)_2$—$CH_2COO^{(-)}$
WA-12: $C_8H_{17}SO_2N(C_3H_7)(CH_2CH_2O)_{16}H$
WA-13: $C_8H_{17}SO_2N(C_3H_7)CH_2COOK$
WA-14: $C_8H_{17}SO_3K$
WA-15: $C_8H_{17}SO_2N(C_3H_7)(CH_2CH_2O)_4\ (CH_2)_4SO_3Na$
WA-16: $C_8H_{17}SO_2N(C_3H_7)(CH_2)_3OCH_2CH_2N^{(+)}(CH_3)_3$—$CH_2$—$C_6H_4$—$SO_3^{(-)}$
WA-17: $C_8H_{17}SO_2N(C_3H_7)CH_2CH_2CH_2N^{(+)}(CH_3)_2$—$CH_2COO^{(-)}$ In the thermally processed image forming material of the present invention, the image forming layer, the protective layer for the image forming layer, undercoat or back layer may contain a dye for an antihalation purpose as discussed in the paragraphs from [0204] to [0208] of JP-A-11-84573, and the paragraphs from [0240] to [0241] of Japanese Patent Application No. 11-106881.

The image forming layer of the thermally processed image forming material of the present invention may contain a dye or pigment of various types so as to improve the color tone or prevent the irradiation. Any dye or pigment may be used in the photosensitive layer, and examples thereof include compounds described in the paragraph [0297] of JP-A-11-119374. The compounds may be added in any form of solution, emulsified product or solid microgram dispersion or may be added in the state mordanted with a polymer mordant. The amount of such compounds used may be determined according to desired absorbance, and, in general, the compounds are preferably used in an amount of from $1\times10^{-6}$ to 1 g per $m^2$ of the thermally processed image forming material.

When an antihalation dye is used in the present invention, such dye may be any compound provided that it has a desired absorption within a predetermined wavelength region, that it is sufficiently low in absorption in the visible wavelength region after the processing, and that it can allow the back layer to exhibit a desired absorbance spectrum pattern. Compounds disclosed in the paragraph [0300] of JP-A-11-119374 are available. Other available methods include such that reducing density produced by dye using heat-assisted fading as described in Belgian Patent No. 733,706, and such that decreasing the density by photo-irradiation-assisted fading described in JP-A-54-17833.

The pH of the surface of the thermally processed image forming material of the present invention is preferably adjusted to 6.0 or below before the heat development, and more preferably 5.5 or below. The lower limit is set at approx. pH 3, while being not limited thereto.

Using an organic acid such as phthalic acid, non-volatile acid such as sulfuric acid, or volatile base such as ammonia is preferable from the viewpoint of reducing pH of the surface. Ammonia is particularly preferable to attain a low pH of the surface since it is highly volatile and can easily be removed in the coating process or before heat development process. A method for measuring pH is disclosed in the paragraph [0123] of Japanese Patent Application No. 11-87297.

Heat development of the thermally processed image forming material of the present invention can be effected using, for example, a heat developing apparatus as disclosed in JP-A-2000-171935 and Japanese Patent Application No. 11-106881, in which in the preheating zone the recording material is conveyed with opposed rollers, and in the heat developing zone the material is conveyed so that the top surface of the image forming layer side thereof is roller-driven, and the opposite side is slid on a smooth plane. In such development process, a ratio of friction coefficients of the outermost surface of the image forming layer and the outermost surface of the back layer, at the development temperature, is selected as 1.5 or above, and at most 30 or around, although the upper limit being not specifically limited. A friction coefficient of the back layer ($\mu b$) is preferably 1.0 or below, and more preferably 0.8 to 0.05, which can be obtained from the equation below:

$$\text{ratio of friction coefficient} = \mu e / \mu b$$

where, $\mu e$=dynamic friction coefficient between the roller members of the heat developing apparatus and the outermost surface of the image forming layer side; and $\mu b$=dynamic friction coefficient between the smooth plane member and the surface of the back layer.

The sliding property between the contact members of the heat developing apparatus and the outermost layers of the image forming layer side and/or the rear side can be adjusted by adding the slipping aid to the outermost layers and by controlling the amount of addition thereof.

In the present invention, it is preferable that at least either one, and more preferably both, of the outermost layers on the image forming layer side and the opposite side thereof of the thermally processed image forming material has a Beck smoothness of 2,000 seconds or below, and more preferably 10 to 2,000 seconds.

The Beck smoothness in the present invention will readily be obtained according to Japanese Industrial Standard (JIS) P8119 "Paper and board—Determination of smoothness by Beck method" and TAPPI standard method T479.

Beck smoothness of the outermost layers on the image forming layer side and the opposite side thereof of the thermally processed image forming material can be controlled by properly adjusting the grain size and the amount of addition of a matting agent included in such layers, as disclosed in the paragraphs from [0052] to [0059] of JP-A-11-84573.

In a preferred embodiment of the present invention, an intermediate layer can optionally be provided in addition to the image recording layer and the protective layer, where these pluralities of layers can be formed by the simultaneous multilayer coating using water-base coating liquids for the purpose of improving the productivity. Methods for the coating include extrusion coating, slide coating, curtain coating, and a particularly preferable one relates to the slide bead coating disclosed in FIG. 1 of JP-A-2000-2964.

In the case of using a silver halide photosensitive material containing gelatin as a major binder, the photosensitive material will rapidly be cooled in a first drying zone provided on the downstream of a coating die, where a coated film is immobilized due to gellation of the gelatin. Thus immobilized and non-fluidized coated film is then sent to a second drying zone, where, and in any successive drying zone, the solvent contained in the coated film will be vaporized to afford a solid film. Drying system for the second drying zone and thereafter include a air-loop system in which air jet is blown from an U-duct to the support carried on the rollers, and a spiral system (air floating system) in which the support is dried during conveyance as being spirally wound on a cylindrical duct.

As for the coating liquid containing polymer latex as a major component of the binder, preheating only in the first drying zone may sometimes be insufficient since the rapid cooling cannot immobilize the coated film. In such a case, the drying system suitable for a silver halide photographic photosensitive material will likely to cause non-uniform liquid flow or drying, which may result in serious degradation in the coated surface quality.

A preferable drying system for the present invention is not limited to that having the first and second drying zones as disclosed in JP-A-2000-2964, but such that using a horizontal drying zone at least the constant-rate drying is completed. Conveyance of the support immediately after the coating through the introduction into the horizontal drying zone is not necessarily performed in a horizontal manner, and a rising angle from the horizontal level of the coating apparatus may reside in 0 to 70°. It is to be understood that the horizontal drying zone described in this specification never requires the conveyance of the support in an absolutely horizontal manner, but permits deflection from the horizontal level of the coating apparatus within ±15°.

The constant-rate drying in the context of this specification means a drying process such that the whole amount of incoming heat while keeping the liquid film temperature constant will be consumed for vaporizing the solvent. The falling-rate drying means a drying process such that the drying rate falls in the terminal period due to miscellaneous factors (rate-determined by internal water migration or diffusion within the material, or recession of the vaporization surface), and incoming heat also contributes the temperature rise of the liquid film. A critical moisture content allowing transition from the constant-drying-rate process to falling-drying-rate process resides in a range from 200 to 300%. While a drying process known for the silver halide photographic photosensitive material may also be applicable since the coated film will thoroughly be dried to be immobilized upon completion of the constant-rate drying, more preferable in the present invention is to sustain the drying in the horizontal drying zone until the final dry point is reached even after the constant-rate drying period.

A preferable drying temperature in the formation of the image forming layer and/or protective layer is such that higher than the minimum film-formation temperature (MFT) of the polymer latex (generally higher than the glass transition point of the polymer by 3 to 5°), usually set at a temperature equivalent to the liquid film surface temperature during the constant-rate drying is applied, and is often set within a range from 25 to 40° C. limited by performances of the production facility. The dry bulb temperature during the falling-rate drying is preferably set to a temperature lower than the glass transition point of the support (usually 80° C. or below for PET support). The liquid film surface temperature in the context of the present invention refers to a surface temperature of the coated liquid film, and more specifically solvent film, coated on the support, and the dry bulb temperature refers to a temperature of drying air flow in the drying zone.

If the constant-rate drying is proceeded by conditions allowing temperature fall of the liquid film surface, the drying tends to be incomplete, which will significantly degrade the film forming property in particular of the protective layer and will readily produce cracks on the film surface. This may also weaken the film strength so that a critical problem such that getting scratches during the conveyance within an exposure apparatus or heat developing apparatus may occur.

On the contrary, if the drying is effected so as to raise the liquid film surface temperature, surface irregularity tends to occur since the protective layer mainly composed of the polymer latex can rapidly form a film, whereas the lower layers including the image forming layer can still fluidize. Applying an excessive heat on the support (base) exceeding the glass transition point thereof also tends to ruin the dimensional stability or curling resistance of the photosensitive material.

In particular in the simultaneous multilayer coating, in which the upper layer is stacked on the lower layer still in the wet state and both layer are concomitantly dried, and while the same will apply to the sequential coating in which the upper layer is formed on the lower layer being already coated and dried, it is preferable to adjust a pH difference between the coating liquids for the image forming layer and the protective layer to 2.5 or below, where a smaller pH difference the better. Increase in the pH difference tends to promote a microscopic agglomeration at the interface of the coated liquids, which will result in a critical failure in the surface property such as coating streaks during long span continuous coating.

Viscosity at 25° C. of the coating liquid for the image forming layer is preferably $15\times10^{-3}$ Pa.s to $100\times10^{-3}$ Pa.s, and more preferably $30\times10^{-3}$ Pa.s to $70\times10^{-3}$ Pa.s. Viscosity at 25° C. of the coating liquid for the protective layer is preferably $5\times10^{-3}$ Pa.s to $75\times10^{-3}$ Pa.s and more preferably $20\times10^{-3}$ Pa.s to $50\times10^{-3}$ Pa.s. The viscosities can be measured using a B-type viscometer.

Winding up after the drying is preferably conducted at 20 to 30° C., and a relative humidity of 45±20%. The winding orientation can be optional for the convenience of successive processes, that is, the image producing plane may be orientated outward or inward. For the case that the material is processed in a rolled state, such rolled state may preferably be inside-out in order to eliminate the curl generated in the winding. The in-package humidity for the thermally processed image forming material is preferably controlled within a range from 20 to 55% (measured at 25° C.).

In the conventional photographic emulsion coating liquid, which is a viscous liquid containing silver halide grains and gelatin matrix, air bubbles will easily dissolve into the liquid and disappear simply by feeding the liquid under pressure, and the air bubbles will scarcely emerge again even the atmospheric pressure is recovered during the coating.

On the contrary, the coating liquid for the image forming layer containing the organic acid silver salt, polymer latex and the like for use in the present invention tends to result in insufficient defoaming simply by the pressure liquid feeding. Thus it is preferable to feed the liquid so as not to generate the gas-liquid interface under ultrasonic vibration for deforming.

Defoaming of the coated liquid in the present invention is preferably performed by preliminarily degassing the precoating liquid under a reduced pressure, and feeding the coating liquid while maintaining the liquid under a pressure of 1.5 kg/cm$^2$ or above, under a continuous flow so as to prevent gas-liquid interface from generating, and under application of ultrasonic vibration. A specific example of such method is described in JP-B-55-6405 (line 20 on page 4 to line 11 on page 7). An apparatus for implementing such defoaming is exemplified as that disclosed in Example and FIG. 3 of JP-A-2000-98534.

Pressure preferably exerted on the coating liquid is preferably 1.5 kg/cm$^2$ or above, more preferably 1.8 kg/cm$^2$ or above, and an upper limit is around 5 kg/cm$^2$ in general, while being not limited thereto. Sound pressure of the applied ultrasonic wave is 0.2 V or above, and more preferably 0.5 to 3.0 V. Higher sound pressure is more preferable in general, where too high sound pressure will cause cavitation and thus locally raise the temperature, which may result in fog. While the sound frequency is not limitative, it is generally selected at 10 kHz or above, and more preferably 20 to 200 kHz. Now, the reduced-pressure defoaming herein relates to closing the tank (liquid reserving tank or storage tank in general), reducing the pressure in the tank to expand the air bubbles entrained in the coating liquid, and making the bubbles escape from the liquid facilitated by their increased buoyancy. The pressure during the reduced-pressure defoaming is −200 mmHg or lower (a pressure lower than the atmospheric pressure by 200 mg or more), and more preferably −250 mmHg or lower, and a lowest pressure of −800 mmHg or around in general, while being not limited thereto. Period of pressure reduction is 30 minutes or longer, and more preferably 45 minutes or longer, where an upper limit is not specifically defined.

For the case that the thermally processed image forming material of the present invention is used as a mask in a process of printing plate making with a presensitized plate, such image recording material after the heat development will have image information for setting exposure conditions for exposing the presensitized plate by a photoengraving machine, mask pattern, and plate making conditions such as conveyance conditions of the presensitized plate. Thus the density (amount of use) of the foregoing irradiation preventive dye, antihalation dye or filter dye is limited so as not to interfere the detection of such information. That is, $D_{min}$ (minimum density) in the wavelength range recognizable by a sensor must be low, which is expressed by an absorbance of 0.3 or below, since the information is detected with an LED or laser device. For example, a photoengraving machine model S-FNRIII (manufactured by Fuji Photo Film Co., Ltd.) has a detector for detecting register and a 670-nm light source in a bar code reader. Also a photoengraving machine model APML Series (manufactured by Shimizu Seisakusha K.K.) has a 670-nm light source in a bar code reader. So that too high $D_{min}$ (minimum density) around 670 nm will prevent the information on the film from being correctly read out, which will result in process error in the photoengraving machine due to conveyance failure and inappropriate exposure. Thus information reading using a 670-nm light source requires low $D_{min}$ around 670 nm, and an absorbance in a wavelength region from 660 to 680 nm after the heat development of 0.3 or below, more preferably 0.25 or below. While the lower limit is not limitative, it will generally be 0.10 or around.

In the present invention, an exposure apparatus used for the image-wise exposure may be of any type provided that it affords an exposure period of not longer than $10^{-7}$ seconds, and is preferably in general such apparatus having a light source such as a laser diode (LD) or light emitting diode (LED). LD is more preferable in terms of high output and excellent resolution. These light sources may be of any type provided that they can emit light within an electromagnetic spectral range of desired wavelengths. Available LDs include, for example, a dye laser, gas laser, solid state laser and semiconductor laser.

In the present invention, the exposure is effected so that the beam loca are partially overlapped. The overlap means that the subscanning pitch width is smaller than the beam spot diameter. When the beam spot diameter is expressed by, for example, a half width of the beam intensity, the overlap can quantitatively be expressed by FWHM/subscanning pitch width (an overlap coefficient).

The over lap coefficient is preferably 0.2 or larger in the present invention.

There is no particular limitation on the scanning system of the light source of the exposure apparatus employed in the present invention, and available systems include outer cylinder surface scanning system, inner cylinder surface scanning system and planar scanning system. Both of single channel and multi-channel systems are available for the light source, where the multi-channel system is preferable for the outer cylinder surface scanning system.

The thermally processed image forming material of the present invention has a low haze at the time of exposure and is liable to incur generation of interference fringes. For preventing the generation of interference fringes, a technique of entering a laser light obliquely with respect to the recording material disclosed in JP-A-5-113548, and a method of using a multimode laser disclosed in International Patent Publication WO95/31754 are known and these techniques are preferably used.

The thermally processed image forming material of the present invention may be developed by any method, while in general the development is performed by elevating the temperature of the recording material after the image-wise exposure. Preferred embodiments of the heat-developing apparatus used include: those making the thermally processed image forming material into contact with a heat source such as a heat roller or heat drum as disclosed in JP-B-5-56499, JP-A-9-292695, JP-A-9-297385 and International Patent Publication WO95/30934; and those of non-contacting type as disclosed in JP-A-7-13294, International Patent Publications WO97/28489, WO97/28488 and WO97/28487. Of these, the non-contacting type heat-developing apparatus is preferred. The development temperature is preferably from 80 to 250° C., more preferably from 100 to 140° C. The development time is preferably from 1 to 180 seconds, more preferably from 10 to 90 seconds.

For preventing uneven processing due to dimensional changes in the thermally processed image forming material of the present invention during heat development, it is preferable to heat the material at a temperature of 80° C. or above and less than 115° C. for 5 seconds or more so as to prevent the image from appearing, and then develop the material by heating at a temperature of 110 to 140° C. to produce the image (so-called multi-stage heating method).

In the heat development of the thermally processed image forming material of the present invention, a part of the components contained in such material or a part of decomposition products thereof ascribable to the heat development may vaporize due to heat exposure at 110° C. or above. Such vaporized components are known to exert various adverse effects such as causing non-uniform development, corroding composition members of the heat developing apparatus, deforming image through depositing at a low temperature site to produce foreign materials, and adhering on and thus fouling the image. Known methods for eliminating such adverse effects relate to providing the heat developing apparatus with a fan, and to optimizing the air flow within the apparatus. These measures may effectively be combined.

A heating apparatus for effecting contact heating of the film and provided with a filter cartridge is disclosed in International Patent Publications WO95/30933, WO97/21150 and JP-W-A-10-500496 (the code "JP-W-A" as used herein means an "international application published in Japanese for Japanese national phase"), the filter cartridge having a first opening packed with bond-absorption grains for introducing volatiles and a second opening for exhaust. Use of a filter comprising a heat-conductive condensing collector and a gas-absorption grain filter as combined therewith is disclosed in WO96/12213 and JP-W-A-10-507403. These measures may properly be employed in the present invention.

In U.S. Pat. No. 4,518,845 and JP-B-3-54331, disclosed is a constitution involving an apparatus for exhausting volatile components emitted from the film, a pressure apparatus for pressing the film to a heat-conductive member, and a heating apparatus for heating the heat-conductive member. WO98/27458 discloses a method for removing volatile components emitted from the film, which may be causative of increased fog, from the surface of such film. These measures may also properly be employed in the present invention.

An exemplary constitution of a heat developing apparatus used for the heat development of the thermally processed image forming material of the present invention is shown in FIG. 1. FIG. 1 shows a side view of the heat developing apparatus. The apparatus has a feed-in roller pair 11 (the upper roller being a silicone rubber roller and the lower one being an aluminum-made heat roller) for introducing the thermally processed image forming material 10 into a heating section while straightening and preheating it, and has an eject roller pair 12 for ejecting the thermally processed image forming material 10 from the heating section after the heat development in a straightened manner. The thermally processed image forming material 10 is heat-developed during a period of its travel from the feed-in roller pair 11 to the eject roller pair 12. In a conveying means for conveying the thermally processed image forming material 10, a plurality of rollers 13 are aligned on the side where the contact with the top surface of the image forming layer side may occur, and a smooth plane 14 is provided on the opposite side where the contact with the back surface may occur, the surface of the smooth plane 14 being laminated with a non-woven fabric (made of, for example, aromatic polyamide or polytetrafluoroethylene). The thermally processed image forming material 10 is conveyed with the aid of the plurality of rollers 13 driven under contact with the image forming layer side, while the back surface being slid on the smooth plane 14. As a heating means, heaters 15 are aligned behind the rollers 13 and the smooth plane 14 so as to heat the thermally processed image forming material 10 from both sides. Such heating means can be typified as a plate heater or the like. The clearance between the rollers 13 and the smooth plane 14 may vary depending on the materials composing the smooth plane 14, and can properly be adjusted, preferably to 0 to 1 mm, so as to allow a smooth conveyance of the thermally processed image forming material 10.

Although materials and members composing the rollers 13 and smooth plane 14 may be of any type provided that they are durable to high temperatures and do not adversely affect the conveyance of the thermally processed image forming material 10, silicone rubber is preferable for the surface of the rollers 13, and aromatic polyamide or Teflon (product name of polyteterafluoroethylene) for the smooth plane 14. It is also preferable to compose the heating means with a plurality of unit heaters and to arbitrarily select the individual temperatures.

The heating section is composed of a preheating section "A" having the feed-in roller pair 11 and a heat developing heating section "B" having the heater 15, where the preheating section "A" placed on the upper stream of the heat developing section "B" is preferably conditioned at a temperature lower than the heat development temperature (for example, lower by 10 to 30° C. or around); at a temperature and process time sufficient for vaporize the moisture contained in the thermally processed image forming material 10; and more specifically at a temperature higher than the glass transition point ($T_g$) of the support of the thermally processed image forming material 10 so as to avoid non-uniformity in the development. Temperature difference between the preheating section "A" and the heat developing section "B" is preferably within ±1° C., and more preferably within ±0.5.° C.

On the downstream side of the heat developing section "B", provided is a slow cooling section "C" having an eject roller pair 12 and a guide plate 16. The guide plate 16 is preferably made of a material with a low heat conductivity, and the cooling is preferably performed gradually so as to avoid deformation of the thermally processed image forming material 10, and more specifically at a cooling rate of 0.5 to 10° C./sec.

While the apparatus has been described referring to the illustrated example, a variety of other configurations, including such that disclosed in JP-A-7-13294, are allowable without limitation for use in the present invention. For the case of applying the multi-stage heating method, two or more heat sources differed in temperature settings can be provided so as to allow successive heating at different temperatures.

The thermally processed image forming material of the present invention is characterized in that less causative of sticking with each other in a form of commercial product.

EXAMPLE

The present invention will be explained more specifically hereinafter by referring to the following Examples. The materials, amounts of use thereof, ratios, operations, procedures and the like mentioned in the following Examples may properly be modified without departing from the spirit of the present invention. The scope of the present invention, therefore, is by no means limited to the specific Examples described below.

Example 1

Preparation and Evaluation of Thermally Processed Image Forming Materials Differ in Monomer Composition <<Preparation of Silver Halide Emulsion "A">>

To 700 ml of water, 11 g of alkali-treated gelatin (calcium content ≦2,700 ppm), 30 mg of potassium bromide and 1.3 g of sodium 4-methylbenzenesulfonate were dissolved at 40° C., pH of the mixture was adjusted at 6.5, and added thereto were 159 ml of an aqueous solution containing 18.6 g of silver nitrate and an aqueous solution containing 1 mol/L of potassium bromide, $5\times10^{-6}$ mol/L of $(NH_4)_2RhCl_5(H_2O)$, and $2\times10_{-5}$ mol/L of $K_3IrCl_6$ over 6 minutes and 30 seconds by the controlled double jet method while keeping pAg at 7.7. The further added were 476 ml of an aqueous solution containing 55.5 mg of silver nitrate and an aqueous halogen salt solution containing 1 mol/L of potassium bromide and $2\times10^{-5}$ mol/L of $K_3IrCl_6$ over 28 minutes and 30 seconds by the controlled double jet method while keeping pAg at 7.7. The pH of the mixture was lowered to effect agglomerative precipitation and desalting, 51.1 g of low-molecular-weight gelatin (average molecular weight=15,000, calcium content ≦20 ppm) was added, and the pH and pAg were adjusted to 5.9 and 8.0, respectively. The obtained grains were found to be cubic grains having an average grain size of 0.08 μm, a coefficient of variation of the projected area of 9%, and a ratio of [100] plane of 90%.

The obtained silver halide grains were then heated to 60° C., added with $7.6\times10^{-5}$ mol/mol Ag of sodium benzenethiosulfonate, and 3 minutes after further added with $7.1\times10^{-5}$ mol/mol Ag of triethylthiourea, ripened for 100 minutes, added with $5\times10^{-4}$ mol/mol Ag of 4-hydroxy-6-methyl-1,3,3a,7-tetrazaindene and 0.17 g of Compound "A" shown below, and then cooled to 40° C.

While keeping the liquid temperature at 40° C. under stirring, $4.7\times10^{-2}$ mol/mol Ag of potassium bromide (as an aqueous solution), $12.8\times10^{-4}$ mol/mol Ag of Sensitization Dye "A" listed below (as an ethanol solution), and $6.4\times10^{-3}$ mol/mol Ag of Compound "B" listed below (as a methanol solution) were added, and 20 minutes after the mixture was rapidly cooled to 30° C., thereby to complete the preparation of silver halide emulsion "A".

Sensitization Dye "A"

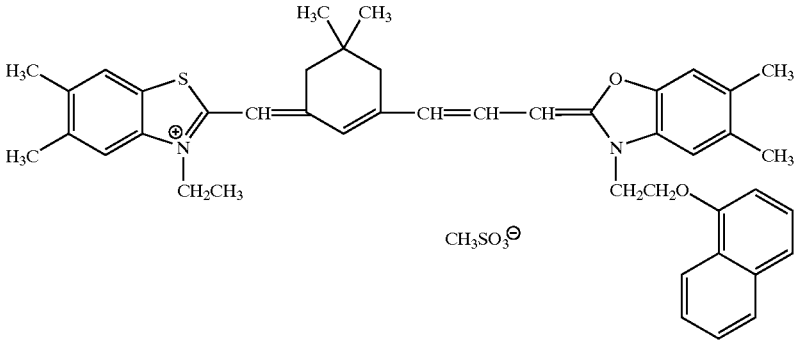

Compound "A"

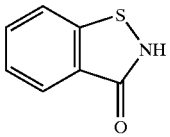

Compound "B"

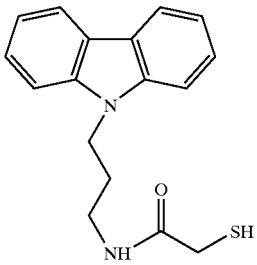

<<Preparation of Silver Behenate Dispersion "A">>

Sodium behenate solution was prepared by mixing 87.6 g of behenic acid (Edenor C22-85R, product of Henkel Corporation), 423 ml of distilled water, 49.2 ml of a 5 N aqueous NaOH solution and 120 ml of tert-butanol, and allowing the mixture to react at 75° C. for one hour under stirring. Independently, 206.2 ml of aqueous solution containing 40.4 g of silver nitrate was prepared and kept at 10° C. A reaction vessel containing 635 ml of distilled water and 30 ml of tert-butanol was kept at 30° C., and an entire volume of the sodium behenate solution and an entire volume of the silver nitrate aqueous solution were added at constant flow rates over 62 minutes and 10 second, and over 60 minutes, respectively. In this process, only the silver nitrate aqueous solution was added in a first 7-minute-and-20-second period after the start of the addition, then sodium behenate solution was concomitantly added, and only sodium behenate solution was added in a last 9-minute-and-30-second period after the end of addition of the aqueous silver nitrate solution. The temperature of the content in the reaction vessel was kept at 30° C., and was controlled externally so as to avoid the liquid temperature rise. A piping in a feeding system of the sodium behenate solution was heated using a steam trace, in which a steam aperture was adjusted so as to control the outlet liquid temperature at the end of the feed nozzle at 75° C. A piping in a feeding system of the aqueous silver nitrate solution was heated by circulating cold water in an outer portion of the double pipe. Points of addition of the sodium behenate solution and silver nitrate aqueous solution were symmetrically arranged centered round a stirring axis, and the heights of which were adjusted so as to avoid contact with the reaction solution.

After completion of the addition of the sodium behenate solution, the mixture was allowed to stand for 20 minutes under stirring with the temperature thereof unchanged, and then cooled to 25° C. The solid content was separated by suction filtration, and then washed with water until electric conductivity of the wash water decreased as low as 30 μs/cm. The obtained solid content was stored in a form of a wet cake without drying.

From electron microscopic photographing, the obtained silver behenate grain was found to be a scaly crystal having an average sphere-equivalent diameter of 0.52 μm, an average grain thickness of 0.14 μm, and a sphere-equivalent coefficient of variation of 15%.

Next, the silver behenate dispersion was prepared by the procedures described below. To the wet cake equivalent to a dry weight of 100 g, 7.4 g of polyvinyl alcohol (product name; PVA-217, average degree of polymerization of ca. 1,700) and water were added to adjust a total weight of 385 g, and the mixture was then preliminarily dispersed using a homomixer. The preliminarily dispersed solution was then thoroughly dispersed three times using a dispersion apparatus (Micro Fluidizer M-110S-EH, manufactured by Micro Fluidex International Corporation, equipped with G10Z interaction chamber) under an operating pressure of 1,750 kg/cm$^2$, to obtain a silver behenate dispersion "A". During the dispersion, cooling operation was effected using coiled heat exchangers attached to the inlet side and outlet side of the interaction chamber, and the temperature of the coolant was controlled to keep the desired dispersion temperature.

The silver behenate grains contained in thus obtained silver behenate dispersion were found to have a volume weighted mean diameter of 0.52 μm and a coefficient of variation of 15%. The grain size was measured using MasterSizer X manufactured by Malvern Instruments, Ltd. Observation through an electron microscope revealed a ratio of the long edge and short edge of 1.5, a grain thickness of 0.14 μm, and an average aspect ratio (ratio of circle-equivalent diameter of a projected grain area and grain thickness) of 5.1.

<<Preparation of Solid Micrograin Dispersion of 1,1-Bis(2-Hydroxy-3,5-Dimethylphenyl)-3,5,5-Trimethylhexane (Reducing Agent)>>

Ten kilograms of 1,1-bis(2-hydroxy-3,5-dimethylphenyl)-3,5,5-trimethylhexane, 10 kg of a 20 wt % aqueous solution of a modified polyvinyl alcohol (Poval MP-203, product of Kuraray Co., Ltd.) and 16 kg of water were thoroughly mixed to prepare a slurry. The slurry was then transferred using a diaphragm pump to a lateral sand mill (UVM-2, product of Aimex, Ltd.) packed with zirconia bead with an average diameter of 0.5 mm, added with 4 g of benzoisothiazolinone sodium salt and water so as to adjust the concentration of the reducing agent to 25 wt %, thereby to obtain a solid micrograin dispersion of the reducing agent. The reducing agent grains contained in thus obtained dispersion were found to have a median diameter of 0.44 μm, a maximum diameter of 2.0 μm or less, and a coefficient of variation of the average grain size of 19%. The obtained dispersion was filtered through a polypropylene filter with a pore size of 3.0 μm to separate dust or other foreign matters and then stored.

<<Preparation of Solid Micrograin Dispersion of Organic Polyhalogen Compound "A">>

Ten kilograms of tribromomethyl(4-(2,4,6-trimethylphenyl-sulfonyl)phenyl)sulfone, 10 kg of a 20 wt % aqueous solution of a modified polyvinylalcohol (Poval MP-203, product of Kuraray Co., Ltd.), and 639 g of a 20 wt % aqueous solution of sodium triisopropylnaphthalenesulfonate, 400 g of Surfinol 104E (product of Nissin Chemical Industry Co., Ltd. ), and 640 g of methanol were added with 16 kg of water, and then mixed thoroughly to prepare a slurry. The slurry was then fed with the aid of a diaphragm pump to a lateral sand mill (UVM-2 manufactured by Aimex, Ltd.) packed with zirconia bead with an average diameter of 0.5 mm, dispersed for 5 hours, and then added with water so as to adjust the concentration of Organic Polyhalogen Compound "A" to 25 wt %, thereby to obtain a solid microgram dispersion of Organic Polyhalogen Compound "A". The Organic Polyhalogen Compound grains contained in thus obtained dispersion were found to have a median diameter of 0.36 μm, a maximum diameter of 2.0 μm or less, and a coefficient of variation of the average grain size of 18%. The obtained dispersion was filtered through a polypropylene filter with a pore size of 3.0 μm to separate dust or other foreign matters and then stored.

<<Preparation of Solid Hicrograin Dispersion of Organic Polyhalogen Compound "B">>

Five kilograms of tribromomethylnaphthylsulfone, 2.5 kg of a 20 wt % aqueous solution of a modified polyvinyl alcohol (Poval MP-203, product of Kuraray Co., Ltd.), and 213 g of a 20 wt % aqueous solution of sodium triisopropylnaphthalenesulfonate were added with 10 kg of water, and then mixed thoroughly to prepare a slurry. The slurry was then fed with the aid of a diaphragm pump to a lateral sand mill (UVM-2 manufactured by Aimex, Ltd.) filled with zirconia bead with an average diameter of 0.5 mm, dispersed for 5 hours, added with 2.5 g of benzoisothiazolinone sodium salt and water so as to adjust the concentration of Organic Polyhalogen Compound "B" to 20 wt %, to obtain a solid microgram dispersion of Organic Polyhalogen Compound ABE. Organic polyhalogen compound grains contained in thus obtained dispersion were found to have a median diameter of 0.38 μm, a maximum diameter of 2.0 μm or less, and a coefficient of variation of the average grain size of 20%. The obtained dispersion was filtered through a polypropylene filter with a pore size of 3.0 μm to separate dust or other foreign matters and then stored.

<<Preparation of Solid Micrograin Dispersion of Compound "Z">>

To 3.5 kg of a material containing 85 wt % of Compound "Z" (R-054, product of Sanko K.K.), 1 kg of a modified polyvinyl alcohol (Poval MP-203, product of Kuraray Co., Ltd.) and 15 kg of water were added and then thoroughly mixed to prepare a slurry. The slurry was then fed with the aid of a diaphragm pump to a lateral sand mill (UVM-2 manufactured by Aimex, Ltd.) filled with zirconia bead with an average diameter of 0.5 mm, dispersed for 7 hours, added with water so as to adjust the concentration of Compound "Z" to 10 wt %, to obtain a solid microgram dispersion of Compound "Z". Compound "Z" grains contained in thus obtained dispersion were found to have a median diameter of 0.45 μm, a maximum diameter of 4.0 μm or less, and a coefficient of variation of the grain size of 17%. The obtained dispersion was filtered through a polypropylene filter with a pore size of 3.0 μm to separate dust or other foreign matters and then stored.

<<Preparation of 5-Isopropylphthalazine Dispersion>>

Formulation (per 100 g of the final dispersion) and Preparation Procedures:

While stirring 87.9 g of water at the room temperature, 2.0 g of a modified polyvinyl alcohol (Poval MP-203, product of Kuraray Co., Ltd.) was added thereto so as not to generate agglomerate and the stirred for 10 minutes. The mixture was then heated so as to attain an inner temperature of 50° C., and kept under stirring for 1 hour to ensure homogeneous dissolution. The inner temperature was lowered to 40° C. or below, added with 3.0 g of a 20% solution of sodium tripropylnaphthalenesulfonate and 7.14 g of a 70% aqueous aolution of 5-isopropylphthalazine, and then stirred for 30 minutes, thereby to obtain a clear dispersion. The obtained dispersion was filtered through a polypropylene filter with a pore size of 3.0 μm to separate dust or other foreign matters and then stored.

<<Preparation of Solid Micrograin Dispersion of Nucleation Aid>>

Four kilograms of Nucleation Aid "A", 1 kg of polyvinyl alcohol (PVA-217, product of Kuraray Co., Ltd.) and 36 kg of water were mixed and then thoroughly stirred to prepare a slurry. The slurry was then fed with the aid of a diaphragm pump to a lateral sand mill (UVM-2 manufactured by Aimex, Ltd.) packed with zirconia bead with an average diameter of 0.5 mm, dispersed for 12 hours, added with 4 g of benzoisothiazolinone sodium salt and water so as to adjust the concentration of the nucleation aid to 10 wt %, thereby to obtain a solid microgram dispersion of the nucleation aid. The nucleation aid grains contained in thus obtained dispersion were found to have a median diameter of 0.34 μm, a maximum diameter of 3.0 μm or less, and a coefficient of variation of the grain size of 19%. The obtained dispersion was filtered through a polypropylene filter with a pore size of 3.0 μm to separate dust or other foreign matters and then stored.

<<Preparation of Coating Liquid for Image forming layer>>

To the silver behenate dispersion"A" obtained above, added were binder, materials and the silver halide emulsion "A" listed below, and further added with water to obtain a coating liquid for the image forming layer, where all quantities being indicated per mol of silver in the silver behenate dispersion "A". The obtained coating liquid was degassed under a pressure of −350 mmHg for 60 minutes. The coating liquid thus obtained has a pH of 7.7 and a viscosity at 25° C. of $45\times10^{-3}$ Pa.s.

| | | |
|---|---|---|
| SBR latex binder (Lacstar 3307B, product of Dai-Nippon Ink & Chemicals, Inc., glass transition point = 17° C.) | 397 | g as a solid content |
| 1,1-bis-(2-hydroxy-3,5-dimethyl-phenyl)-3,5,5-trimethylhexane | 149 | g as a solid content |
| Organic Polyhalogen Compound "A" | 43.5 | g as a solid content |
| Organic Polyhalogen Compound "B" | 13.5 | g as a solid content |
| sodium ethylthiosulfonate | 0.30 | g |
| benzotriazole | 1.04 | g |
| polyvinyl alcohol (PVA-235, product of Kuraray Co., Ltd.) | 10.8 | g |
| 6-iso-propylphthalazine | 12.8 | g as a solid content |
| sodium dihydrogen orthophosphate dihydrate | 0.37 | g |
| Compound "Z" | 9.7 | g as a solid content |
| Nucleation Aid "A" | 0.03 | mol as a solid content |
| Dye "A" (added as dissolved in a solution also containing a low-molecular-weight gelatin having an average molecular weight of 15,000, and used in an amount affording an optical density of 0.3 at 783 nm) | ca. 0.37 | g |
| silver halide emulsion "A" | 0.06 | mol as silver amount |
| Compound "C" | 2.0 | g |
| Compound "A" (antiseptic) | 40 | ppm in the coating liquid (coated amount = 2.5 mg/m$^2$) |
| methanol | 2 | wt % of the total solvent in the coating liquid |
| ethanol | 1 | wt % of the total solvent in the coating liquid |

(The glass transition point of the coated film was found to be 17° C.)

Compound "Z"

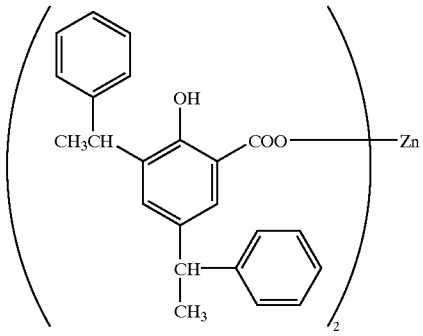

Dye "A"

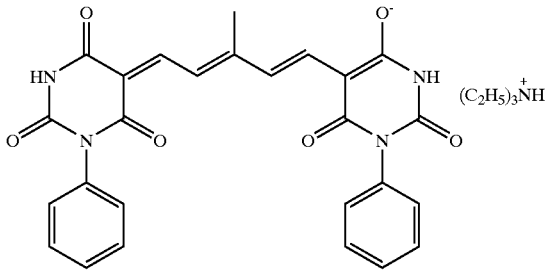

-continued

Compound "C"

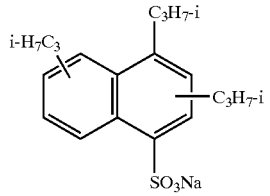

Nucleation Aid "A"

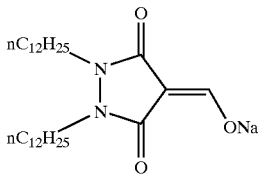

Compound "D"

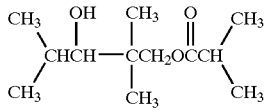

Compound "E"

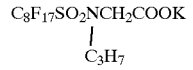

Compound "F"

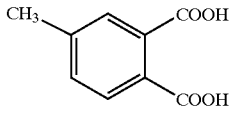

Compound "G"

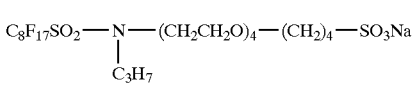

Compound "H"

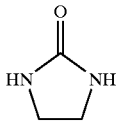

<<Preparation of Coating Liquid for Lower Protective Layer>>

Water was added to 943 g of a polymer latex solution of methyl methacrylate/styrene/2-ethylhexyl acrylate/2-hydrxyethyl methacrylate/acrylic acid copolymer [copolymerization ratio by weight=58.9/8.6/25.4/5.1/2, glass transition point of the copolymer=46° C. (estimation), solid content=21.5%, containing 100 ppm of Compound "A", containing Compound "D" as a filming aid in an amount of 15 wt % of the solid content of the latex, glass transition point of the coating liquid 24° C.], and further added thereto were 1.62 g of Compound "E" described later, 1.98 g of a matting agent (polystyrene grain, average grain size=7 μm, coefficient of variation of the average grain size=8%), and 29.4 g of polyvinyl alcohol (PVA-235, product of Kuraray Co., Ltd.), and still further added thereto was water, thereby to prepare the coating liquid (final methanol content of 2 wt %).

After the preparation, the coating liquid was degassed under a reduced pressure of −400 mmHg for 60 minutes. The coating liquid was found to have a pH of 5.5 and a viscosity at 25° C. of $45\times10^{-3}$ Pa.s. s.

<<Preparation of Coating Liquid for Upper Protective Layer>>

Water was added to 649 g of a polymer latex solution of methyl methacrylate/styrene/2-ethylhexyl acrylate/2-hydrxyethyl methacrylate/acrylic acid copolymer [copolymerization ratio by weight=58.9/8.6/25.4/5.1/2, glass transition point of the copolymer=46° C. (estimation), solid content=21.5%, containing 100 ppm of Compound "A", containing Compound "D" as a filming aid in an amount of 15 wt % of the solid content of the latex, glass transition point of the coating liquid=24° C.], and further added thereto were 6.30 g of a 30 wt % solution of carnauba wax (Cellosol 524, silicone content <5 ppm, product of Chukyo Oil and Fat, Ltd.), 0.23 g of Compound "C", 7.95 g of Compound "F" shown below, 0.93 g of Compound "G" shown below, 1.8 g of Compound "H" shown below, 1.18 g of a matting agent (polystyrene grain, average grain size=7 μm, coefficient of variation of the average grain size=8%), and 12.1 g of polyvinyl alcohol (PVA-235, product of Kuraray Co., Ltd.), and still further thereto added was water, thereby to prepare the coating liquid (final methanol content of 1.5 wt %). s followed by degassing under a reduced pressure lower than the atmospheric pressure by 400 mmHg for 60 minutes. The coating liquid was found to have a pH of 2.8 and a viscosity at 25° C. of $30\times10^{-3}$ Pa.s.

After the preparation, the coating liquid was degassed under a reduced pressure of −400 mmHg for 60 minutes.

<<Fabrication of Polyethylene Terephthalate (PET) Support Having Back/Undercoat Layer>>

(1) Fabrication of PET Support

PET with an intrinsic viscosity of 0.66 (measured in phenol/tetrachloroethane=6/4 (ratio by weight) at 25° C.) was obtained by the general procedures using terephthalic acid and ethylene glycol. The obtained PET was pelletized, dried at 130° C. for 4 hours, melted at 300° C., extruded from a T-die and rapidly cooled, to obtain a unstretched film so as to have a thickness of 120 μm after heat setting.

The film was then stretched in the moving direction 3.3 times at 110° C. using rollers different in the peripheral speed and then transversely stretched 4.5 times at 130° C. using a tenter. Subsequently, the film was heat-set at 240° C. for 20 seconds, and then relaxed by 4% in the transverse direction at the same temperature. Thereafter, a portion chucked by the tenter was slit off and the film was knurled at both edges and then wound up under a tension of 4.8 kg/cm$^2$. Thus, a rolled support of 2.4 m wide, 3,500 m long and 120 μm thick was fabricated.

(2) Formation of Undercoat Layer and Back Layers (2-1) First Undercoat Layer

A coating liquid having a composition shown below was coated on the support in an amount of 6.2 ml/m$^2$, and was stepwisely dried at 125° C. for 30 seconds, at 150° C. for 30 seconds and at 185° C. for 30 seconds.

| | |
|---|---|
| Latex "A" described later | 280 g |
| KOH | 0.5 g |
| polystyrene grain (average grain size = 2 μm, coefficient of variation of the average grain size = 7%) | 0.03 g |
| 2,4-dichloro-6-hydroxy-s-triazine | 1.8 g |
| distilled water | amount for adjusting total weight to 1,000 g |

A coating liquid having a composition shown below was coated on the first undercoat layer in an amount of 5.5 ml/m$^2$, and was stepwisely dried at 125 ° C. for 30 seconds, at 150° C. for 30 seconds and at 170° C. for 30 seconds.

| | |
|---|---|
| deionized gelatin ($Ca^{2+}$ content = 0.6 ppm, jelly strength = 230 g) | 10 g |
| acetic acid (20% aqueous solution) | 10 g |
| Compound-Bc-A | 0.04 g |
| methyl cellulose (2% aqueous solution) | 25 g |
| polyethylene oxy compound | 0.3 g |
| distilled water | amount for adjusting total grain to 1,000 g |

The plane of the PET support opposite to that having the undercoat layer was subjected to corona discharge treatment at 0.375 kV.A. minute/$m^2$, and a coating liquid having a composition shown below was coated on the treated plane in an amount of 13.8 ml/$m^2$, which was then stepwisely dried at 125° C. for 30 seconds, at 150° C. for 30 seconds and at 185° C. for 30 seconds.

| | |
|---|---|
| Jurimer ET-410 (30% water-base dispersion, product of Nippon Jun'yaku K.K.) | 23 g |
| alkali-treated gelatin (molecular weight of ca. 10,000, $Ca^{2+}$ content = 30 ppm) | 4.44 g |
| deionized gelatin ($Ca^{2+}$ content = 0.6 ppm) | 0.84 g |
| Compound-Bc-A (described later) | 0.02 g |
| Dye-Bc-A (described later) (used in an amount affording an optical density of 1.3 to 1.4 at 783 nm) | ca. 0.88 g |
| polyoxyethylenephenyl ether | 1.7 g |
| Sumitex Resin M-3 (8% aqueous solution of water-soluble melamine compound, product of Sumitomo Chemical) | 15 g |
| FS-10D (water-base dispersion of Sb-doped acicular $SnO_2$ grain, product of Ishihara Sangyo Kaisha, Ltd.) | 24 g |
| polystyrene grain (average grain size = 2 μm, coefficient of variation of the average grain size = 7%) | 0.03 g |
| distilled water | amount for adjusting total weight to 1,000 g |

A coating liquid having a composition shown below was coated on the first back layer in an amount of 5.5 ml/$m^2$, and was stepwisely dried at 125° C. for 30 seconds, at 150° C. for 30 seconds and at 170° C. for 30 seconds.

| | |
|---|---|
| Jurimer ET-410 (30% water-base dispersion, product of Nippon Jun'yaku KK) | 57.5 g |
| polyoxyethylenephenyl ether | 1.7 g |
| Sumitex Resin M-3 (8% aqueous solution of water-soluble melamine compound, product of Sumitomo Chemical) | 15 g |

-continued

| | |
|---|---|
| Cellosol 524 (30% aqueous solution, product of Chukyo Oil and Fat, Ltd.) | 6.6 g |
| distilled water | amount for adjusting total weight to 1,000 g |

A coating liquid same as that for the first under coat layer was coated on the second back layer in an amount of 6.2 ml/$m^2$, and was stepwisely dried at 125° C. for 30 seconds, at 150° C. for 30 seconds and at 180° C. for 30 seconds.

(2-6) Fourth Back Layer

A fourth back layer was formed either by Process "A" or Process "B" described below. Which process was applied for the fabrication of the individual thermally processed image forming materials was listed in Tables 1 to 4.

Process "A"

A coating liquid having a composition shown below was coated on the third back layer in an amount of 13.8 ml/$m^2$, and was stepwisely dried at 125° C. for 30 seconds, at 150° C. for 30 seconds and at 170° C. for 30 seconds.

| | |
|---|---|
| Latex (listed in Table 1) | 77.22 g as a solid content |
| Compound-Bc-B | 2.7 g |
| Compound-Bc-C | 0.6 g |
| Compound-Bc-D | 0.5 g |
| 2,4-dichloro-6-hydroxy-s-triazine | 0.8 g |
| polymethyl methacrylate | 7.7 g |

(10% water-base dispersion, average grain size=5 μm, coefficient of variation of the average grain size=7%) distilled water amount for adjusting total weight to 1,000 g Process "B"

A coating liquid having a composition shown below was coated on the third back layer in an amount of 13.8 ml/$m^2$, and was stepwisely dried at 50° C. for 30 seconds, at 75° C. for 30 seconds and at 90° C. for 30 seconds.

| | |
|---|---|
| Latex (listed in Table 1) | 77.22 g as a solid content |
| Compound-Bc-B | 2.7 g |
| Compound-Bc-C | 0.6 g |
| Compound-Bc-D | 0.5 g |
| 2,4-dichloro-6-hydroxy-s-triazine | 0.8 g |
| polymethyl methacrylate | 7.7 g |

(10% ethanol-base dispersion, average grain size=5 μm, coefficient of variation of the average grain size=7%) methyl ethyl ketone/ethanol=9/1 amount for adjusting total weight to 1,000 g Dye-Bc-A

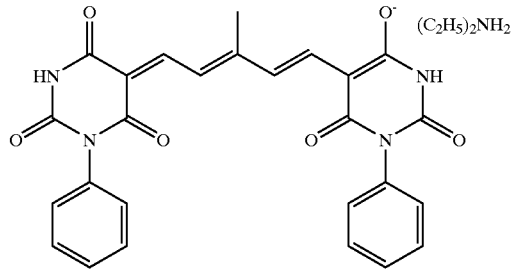

-continued

Compound-Bc-A

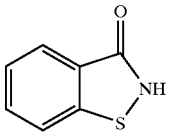

Compound-Bc-B $C_{18}H_{37}OSO_3Na$

Compound-Bc-C $C_8F_{17}SO_3Li$

Compound-Bc-D $C_8F_{17}SO_2-N(C_4H_9)-(CH_2CH_2O)_4-(CH_2)_4-SO_3Na$

Latex-A

Core/shell type latex, core/shell=90/10 (ratio in wt %) core portion: vinylidene chloride/methyl acrylate/methyl methacrylate/acrylonitrile/acrylic acid=93/3/3/0.9/0.1 (wt %) shell portion: vinylidene chloride/methyl acrylate/methyl methacrylate/acrylonitrile/acrylic acid=88/3/3/3/3 (wt %), weight average molecular weight=38,000

(3) Annealing under Conveyance (3-1) Annealing

Thus obtained PET support provided with the back layer and undercoat layer were introduced into an annealing zone of 200 m long set at 160° C., and conveyed at a tension of 2 kg/cm$^2$ and a conveyance rate of 20 m/minute.

(3-2) Post Annealing

Following the foregoing annealing, the PET support was post-annealed by passing through a 40° C. zone for 15 seconds and was wound up into a roll at a winding tension of 10 kg cm$^2$.

<<Fabrication of Thermally Processed Image Forming Material>>

On the undercoat layer, which comprises the lower and upper undercoat layers formed on the support, the above described coating liquid for the image forming layer was coated so as to attain a coated silver amount of 1.5 g/m$^2$ using the slide bead coating method as shown in FIG. 1 of JP-A-2000-2964. Further thereon, the foregoing coating liquid for the lower protective layer was coated by the concomitant stackable coating method with the coating liquid for the image forming layer so as to attain a coated solid amount of the polymer latex of 1.31 g/m$^2$. Still further thereon, the foregoing coating liquid for the upper protective layer was coated so as to attain a coated solid amount of the polymer latex of 3.02 g/m$^2$, thereby to fabricate the thermally processed image forming material.

Drying during the coating was effected, both in the constant-rate and falling-rate periods, at a dry bulb temperature of 70 to 75° C., a dew point of 8 to 25° C., a liquid film surface temperature of 35 to 40° C. in a horizontal drying zone (keeping the support within inclination of 1.5 to 3° from the horizontal level of the coater). Winding after the drying was performed at 25±5° C. under the relative humidity of 45±10% so as to orient the image producing plane outward corresponding to the orientation in the later processing. A humidity in the package for the photosensitive material was adjusted to 20 to 40% (measured at 25° C.), and the film surface of the image-producing side thereof was found to have a pH of 5.0 and a Beck smoothness of 850 seconds.

(Evaluation of Adhesiveness)

The sample was cut into 3.5 cm×3.5 cm test pieces, and then conditioned at 25° C.-40%RH for 16 hours. The conditioned test pieces were stacked by fours, held between a pair of stainless steel plates of the same size, fixed with a tape so as not to get loosen, and the stack was applied with 10 kg load. After being allowed to stand at 50° C. for 24 hours, the load was removed, the stack was cooled to the room temperature, the test pieces were peeled one by one, and the degree of adhesion on the image producing plane was classified into 5 levels shown below, where practical use requires level 3 or above, and level 4 or above will be satisfactory enough:

5 best of all, in which no adhesion mark observed, and no sound audible in the peeling;

4 no adhesion mark but a faint peeling sound audible;

3 faint adhesion mark recognizable on the surface;

2 adhesion mark accounts for approx. 30% of the sample surface area; and 1 adhesion mark accounts for 50% or more of the sample surface area.

Results were shown in Table 1. Adhesion improper for the practical use was observed for the thermally processed image forming material in which 75 wt % or more of the monomer composition of the binder is common for the outermost layers on both planes. On the other hand, the thermally processed image forming material in which the binders contained in the outermost layers on both planes have a common monomer composition to a degree less than 75 wt % showed good results. It is thus clear that the adhesion can be improved by properly selecting the composition.

Abbreviations used in Tables 1 to 4 denote as follows: MMA=methyl methacrylate; St=styrene; 2EHA=2-ethylhexyl acrylate; HEMA=hydroxyethylmethacrylate; AA=acrylic acid; BA=butyl acrylate; EA=ethyl acrylate; and MA=methyl acrylate.

TABLE 1

| Number | Composition or product name of latex | Coating method | Evaluation of adhesion |
|---|---|---|---|
| 1-1 (comparison) | MMA/St/2EHA/HEMA/AA = 58.9/8.6/25.4/5.1/2 | Process A | 1 |
| 1-2 (invention) | MMA/St/BA/HEMA/AA = 58.9/8.6/25.4/5.1/2 | Process A | 3 |
| 1-3 (invention) | MMA/MA = 43/57 | Process A | 4 |
| 1-4 (invention) | St/BA = 64/36 | Process A | 4 |
| 1-5 (invention) | Chemipearl S120 (Mitsui Chemical Co., Ltd.) | Process A | 5 |
| 1-6 (invention) | Hydran AP10 (Dai-Nippon Ink & Chemicals, Inc.) | Process A | 5 |
| 1-7 (invention) | L502 (Asahi Chemical Industry Co., Ltd.) | Process A | 4 |
| 1-8 (invention) | CAB171-15S (Eastman Kodak) | Process B | 5 |

Example 2

Fabrication and Evaluation of Thermally Processed Image Forming Material Differ in I/O Value The thermally processed image forming materials were fabricated in a similar as in Example 1 except that the binders (latex) used in the fourth back layer in Example 1 were altered as listed in Table 2. Also the evaluation was performed similarly to that in Example 1.

Results were shown in Table 2. The thermally processed image forming material having an I/O value larger than 0.90 and less than 1.10 showed adhesion improper for the practical use. On the contrary, the thermally processed image forming material having an I/O value escaping from the above range toward hydrophilicity or hydrophobicity was excellent in the anti-adhesive property.

TABLE 2

| Number | Composition or product name of latex | I/O ratio | Coating method | Evaluation of adhesion |
|---|---|---|---|---|
| 2-1 (comparison) | MMA/St/2EHA/HEMA/AA = 58.9/8.6/25.4/5.1/2 | 1.00 | Process A | 1 |
| 2-2 (invention) | MMA/BA = 73/27 | 0.89 | Process A | 3 |
| 2-3 (invention) | MMA/EA = 63/37 | 0.81 | Process A | 4 |
| 2-4 (invention) | MMA/MA = 43/57 | 0.72 | Process A | 5 |
| 2-5 (invention) | St/BA = 64/36 | 2.58 | Process A | 5 |
| 2-6 (invention) | 2EHA/MMA = 70/30 | 1.44 | Process A | 4 |

I/O ratio = (I/O value of a binder contained in the outermost layer of the image producing plane)/(I/O value of a binder contained in the outermost layer of the opposite plane)

Example 3

Fabrication and Evaluation of Thermally Processed Image Forming Material Differ in Softening Point The thermally processed image forming materials were fabricated in a similar manner as in Example 1 except that the binders (latex) used in the fourth back layer in Example 1 were altered as listed in Table 3. Also the evaluation was performed similarly to that in Example 1.

Results were shown in Table 3. The thermally processed image forming material having a softening point of the binder above 100° C. was found to be particularly good in the anti-adhesive property. Especially favorable effect was confirmed when the binder having a softening point higher than its glass transition point was used.

TABLE 3

| Number | Composition or product name of latex | Softening point | $T_g$ | Coating method | Evaluation of adhesion |
|---|---|---|---|---|---|
| 3-1 (comparison) | MMA/St/2EHA/HEMA/AA = 58.9/8.6/25.4/5.1/2 | 46 | 46 | Process A | 1 |
| 3-2 (invention) | St = 100 | 100 | 100 | Process A | 3 |
| 3-3 (invention) | Vylon 200 (Toyobo Co., Ltd.) | 163 | 67 | Process B | 5 |
| 3-4 (invention) | Vylon 103 (Toyobo Co., Ltd.) | 158 | 47 | Process B | 5 |
| 3-5 (invention) | Vylon 300 (Toyobo Co., Ltd.) | 123 | 7 | Process B | 4 |
| 3-6 (invention) | Vylon 500 (Toyobo Co., Ltd.) | 114 | 4 | Process B | 4 |
| 3-7 (invention) | Emulsified dispersion of Vylon 200 | 163 | 67 | Process A | 5 |
| 3-8 (invention) | Emulsified dispersion of Vylon 300 | 123 | 7 | Process A | 4 |

Softening point and $T_g$ are expressed in ° C.
Sample based on St = 100 uses benzyl alcohol as a filming aid in an amount of 10 wt % of the solid content.

Example 4

Fabrication and Evaluation of Thermally Processed Image Forming Materials Differ in Vickers Hardness The thermally processed image forming materials were fabricated in a similar manner as in Example 1 except that the binders (latex) used in the fourth back layer in Example 1 were altered as listed in Table 4. Also the evaluation was performed similarly to that in Example 1.

Results were shown in Table 4. The thermally processed image forming material having a ratio of Vickers hardness larger than 0.95 and less than 1.05 showed adhesion improper for the practical use. On the contrary, the thermally processed image forming material having a ratio of Vickers hardness of 0.95 or below, and in particular 0.90 or below, was found to significantly improve the anti-adhesive property. The ratio of Vickers hardness of 1.05 or above also resulted in an improved anti-adhesive property but in a limited degree of the improvement as compared with the case of 0.95 or below.

TABLE 4

| Number | Composition or product name of latex | Hardness ratio | Coating method | Evaluation of adhesion |
|---|---|---|---|---|
| 4-1 (comparison) | MMA/St/2EHA/HEMA/AA = 58.9/8.6/25.4/5.1/2 | 1.00 | Process A | 1 |
| 4-2 (invention) | MMA/St/2EHA/HEMA/AA = 64.1/17.2/11.6/5.1/2 | 0.91 | Process A | 3 |
| 4-3 (invention) | MMA/St/2EHA/HEMA/AA = 64.1/25.8/3.0/5.1/2 | 0.84 | Process A | 4 |
| 4-4 (invention) | MMA/St/HEMA/AA = 64.1/28.8/5.1/2 | 0.78 | Process A | 5 |
| 4-5 (invention) | MMA/St/2EHA/HEMA/AA = 48.9/8.6/35.4/5.1/2 | 1.06 | Process A | 3 |
| 4-6 (invention) | MMA/St/2EHA/HEMA/AA = 38.9/8.6/45.4/5.1/2 | 1.13 | Process A | 3 |

hardness ratio = (hardness of a binder contained in the outermost layer of the image producing plane)/(hardness of a binder contained in the outermost layer of the opposite plane)

What is claimed is:

1. A thermally processed image forming material having a support, which comprises a first side and a second side, wherein:

the first side has an image forming layer and an outermost layer containing a binder and the second side has an outermost layer containing a binder which is different from the binder of the outermost layer on the first side, the binder contained in the outermost layer on the first side and the binder contained in the outermost layer on the second side have a common monomer of less than 75 wt %, and the outermost layer on the first side contains a polymer latex in an amount of 50 wt % or more of the total binder contained in the outermost layer on the first side or the outermost layer on the second side contains a polymer latex in an amount of 50 wt % or more of the total binder contained in the outermost layer on the second side, wherein a ratio of a Vickers hardness of the binder contained in the outermost layer on the first side and a Vickers hardness of the binder contained in the outermost layer on the second side is within a range from 0.1 to 0.95, or within a range from 1.05 to 10.

2. The thermally processed image forming material as claimed in claim 1, wherein a ratio of an I/O value of the binder contained in the outermost layer on the first side and an I/O value of the binder contained in the outermost layer on the second side is within a range from 0.1 to 0.90, or within a range from 1.10 to 10.

3. The thermally processed image forming material as claimed in claim 1, wherein the binder contained in the outermost layer on the second side has a softening point of 100° C. to 250° C.

4. The thermally processed image forming material as claimed in claim 3, wherein the binder contained in the outermost layer on the second side has a softening point higher than a glass transition point of said binder by 30° C. or more.

5. The thermally processed image forming material as claimed in claim 1, wherein the outermost layer on the first side or on the second side contains a fluorine-containing surfactant.

6. The thermally processed image forming material as claimed in claim 1, wherein the outermost layer on the first side or on the second side contains a slipping aid.

7. The thermally processed image forming material as claimed in claim 2, wherein the outermost layer on the first side or on the second side of the support contains a slipping aid.

8. The thermally processed image forming material according to claim 1, wherein the binder of the outermost layer on the first side and the binder contained in the outermost layer on the second side are each independently selected from one or more of the group consisting of gelatin, polyvinyl acetal, polyvinyl chloride, polyvinyl acetate, cellulose acetate, polyolefin, polyester, polystyrene, polyacrylonitrile, polycarbonate, and polymer latex.

9. The thermally processed image forming material according to claim 8, wherein either the binder of the outermost layer on the first side or the binder contained in the outermost layer on the second side contain polymer latex.

10. The thermally processed image forming material according to claim 9, wherein the polymer latex is selected from the group consisting of methyl methacrylate/ethyl acrylate/methacrylic acid copolymer latex, methyl methacrylate/2-ethylhexyl acrylate/styrene/acrylic acid copolymer latex, styrene/butadiene/acrylic acid copolymer latex, styrene/butadiene/divinylbenzene/methacrylic acid copolymer latex, methyl methacrylate/vinyl chloride/ethyl acrylate/acrylic acid copolymer latex, and vinylidene chloride/ethyl acrylate/acrylonitrile/methacrylic acid copolymer latex.

* * * * *